US011377784B2

(12) United States Patent
Gabbay

(10) Patent No.: US 11,377,784 B2
(45) Date of Patent: Jul. 5, 2022

(54) METHOD AND SYSTEM FOR THE APPLICATION OF CHEMICAL COMPOUNDS TO NATURAL FIBERS AND TREATED FIBERS OBTAINED THEREFROM

(71) Applicant: ARGAMAN TECHNOLOGIES LTD., Jerusalem (IL)

(72) Inventor: Jeffrey S. Gabbay, Jerusalem (IL)

(73) Assignee: ARGAMAN TECHNOLOGIES LTD, Jerusalem (IL)

( * ) Notice: Subject to any disclaimer, the term of this patent is extended or adjusted under 35 U.S.C. 154(b) by 0 days.

(21) Appl. No.: 17/094,869

(22) Filed: Nov. 11, 2020

(65) Prior Publication Data

US 2021/0062405 A1 Mar. 4, 2021

Related U.S. Application Data

(63) Continuation-in-part of application No. PCT/IL2019/050618, filed on May 30, 2019.
(Continued)

(51) Int. Cl.
*D06M 11/42* (2006.01)
*D06M 10/06* (2006.01)
(Continued)

(52) U.S. Cl.
CPC ..... *D06M 11/42* (2013.01); *D06M 10/06* (2013.01); *D06M 23/08* (2013.01); *D06M 23/12* (2013.01);
(Continued)

(58) Field of Classification Search
None
See application file for complete search history.

(56) References Cited

U.S. PATENT DOCUMENTS

2011/0097957 A1* 4/2011 Gedanken ..... D06M 11/44 442/123
2013/0052248 A1* 2/2013 Yuen ..... A41B 11/00 424/404
2015/0140047 A1* 5/2015 Greenwald ..... D06M 10/08 424/401

FOREIGN PATENT DOCUMENTS

EP 3505166 3/2019
JP 2008081871 * 4/2008
WO 2018/038627 3/2018

OTHER PUBLICATIONS

Machine translation of JP2008081871, Henmi et al. (Year: 2008).*
(Continued)

*Primary Examiner* — Shawn Mckinnon
(74) *Attorney, Agent, or Firm* — JMB Davis Ben-David

(57) ABSTRACT

There is provided an impregnated natural fiber including a cuticle and an interior lumen, the cuticle circumscribing the interior lumen; and insoluble particulates possessing a pre-selected property embedded in the fiber. The particulates comprise at least 0.1-30 wt. % of the impregnated fiber and the particulates are embedded on the cuticle and within the lumen of the fiber. The fiber has an increased strength, micronaire value and rate of water absorption. Also provided is a system for surface treating cellulose sliver fibers. The system includes a vessel containing a moist paste which comprises at least one particulate material possessing one or more preselected desired properties, a thickening agent and water. The paste from the vessel is dispensed directly onto sliver fiber ribbon(s). A bore sonotrode generates ultrasonic waves which embed the particulate material(s) in the sliver fibers.

20 Claims, 13 Drawing Sheets

Related U.S. Application Data

(60) Provisional application No. 62/678,280, filed on May 31, 2018.

(51) Int. Cl.
*D06M 23/08* (2006.01)
*D06M 23/12* (2006.01)
*D06M 101/06* (2006.01)

(52) U.S. Cl.
CPC .... *D06M 2101/06* (2013.01); *D06M 2200/00* (2013.01)

(56) References Cited

OTHER PUBLICATIONS

Environmentally friendly low cost approach for nano copper oxide functionalization of cotton designed for antibacterial and photolytic applications, Journal of Cleaner Productions, vol. 204, Dec. 2018, pp. 425-436 (Year: 2018).*
Zoe et al. (Ultrasound-assisted Synthesis of CuO n\Nanostructures Templated by Cotton Fibers, Materials Research Bulletin, 47, 2012, pp. 3135-3140], (Year: 2012).*
Kling ("Stiffening of Cellulose Fibers—A Comparison Between Crosslinking the Fiber Wall and Lumen Loading", Mattias Kling, Lulea University of Technology, Jun. 2001). (Year: 2001).*
Machine translation of WO2018038627 (Year: 2018).*
2. Biotex DH300 product listing B & E Chemicals, Ltd. (3 pages).

* cited by examiner

METHOD AND SYSTEM FOR THE APPLICATION OF CHEMICAL COMPOUNDS TO NATURAL FIBERS AND TREATED FIBERS OBTAINED THEREFROM

CROSS-REFERENCE TO RELATED APPLICATIONS

This is a Continuation-in-Part of International Patent Application No. PCT/IL2019/050618 filed on May 30, 2019, which in turn claims the benefit of U.S. Provisional Patent Application No. 62/678,280, filed on May 31, 2018. The contents of the foregoing patent applications are incorporated by reference herein in their entirety.

FIELD OF THE INVENTION

The present invention relates to a method and a system for treating natural fibers. It also deals with the fibers themselves, particularly cellulose fibers, and articles made therefrom.

BACKGROUND OF THE INVENTION

Surface treatment of textile materials to date is carried out generally when the textile is in the yarn state, in the completed cloth state, or in some cases in the completed product state. For example, cellulose fibers are treated either in yarn form or in the completed cloth state when particular properties such as anti-microbial and/or fire-retardant qualities in a fabric are desired. Treatment of individual fibers has only infrequently been used in industrial textile treatment processes. This is particularly true with cellulose. There are systems in which cellulose fibers are treated, such as in the dyeing of cleaned cotton fibers directly from the bale but before the fibers are carded. The cotton is then processed into yarn using normal spinning equipment. However, these applications are usually not encouraged due to problems they can cause in contaminating other fibers or increasing fiber loss from the carding step or disturbing the orientation of the fibers.

One of the reasons for the lack of industrial processes in which fiber is treated before yarn formation is that when fibers come in contact with a liquid medium, the fibers can bundle into inseparable balls. Alternatively, the fibers can separate and become disordered after they have been carded to produce sliver. The latter is described as fibers in a bundled, ordered, parallel state.

Generally, treatment at the cotton fiber level results in a loss of a not inconsequential percentage of the cotton resulting from broken fibers, and the need for a second carding step.

Yet another disadvantage of processing at the fiber stage, before yarn formation is the possibility of poor interaction between the fiber with a solubilized compound impeding chemical bond formation required for the compound's attachment to the fiber.

Additionally, often treatment at the fiber level makes spinning of yarn difficult due to friction between the processing chemicals on the fibers and the yarn spinning machinery.

Sliver fibers, particularly cellulose sliver fibers, are especially difficult to treat. Sliver, after carding, is comprised of substantially cylindrical fiber bundles in which the fibers in a bundle are oriented parallel to each other. However, sliver is very intractable to work with in water-based processes since water easily disrupts the parallel orientation of the fibers. A significant amount of the oriented fibers is lost because water assists in dispersing the fibers away from the sliver bundles. After treatment in water, a second carding step is usually required to reorient the fibers so that they are essentially parallel one to another. In addition to bringing the fibers into parallel alignment with each other, a second carding step further damages and shortens fibers. For the above reasons the state of the art does not encourage surface treatment processes of individual textile fibers especially for water-based processes.

There remains a need for a system and method of treatment of fibers, such as cellulose, incorporating water-insoluble compounds, which do not suffer from the limitations described above.

SUMMARY OF THE INVENTION

It is an object of the present invention to provide a system and a method for treating of fibers in sliver form with particulates that impart one or more desired properties to the treated fibers.

It is a further object of the invention to provide a system and method which allows for the retention of the parallel orientation of sliver fibers during processing.

Yet another object of the present invention is to provide for an enhanced method and system of treating fibers with acoustic cavitation of the fibers, the cavitation occurring over shorter time intervals than with other cavitation systems and methods that treat yarns and cloth. This results in the use of less energy and greater cost savings while increasing the quantity of particles being attached to the fibers.

A further objective of the system and method is to provide increased particulate concentrations in the fibers treated. This increased particulate pick-up translates into fibers that when included in a finished product provides more effective, longer-lasting particulate-induced activity in the finished product.

Another object is to provide a system and method in which the treated fibers do not lose their original orientation so that a post-production draw frame step to reintroduce parallel orientation to the sliver fibers is unnecessary.

Yet another object of the present system is to provide treated fibers from which the impregnated material leaches out slowly and the treated fibers and yarns and fabrics made therefrom retain their activity after at least 50 industrial washings or 100 home washings.

A further object of the present system is to provide fibers with insoluble particulates which are more deeply embedded in fibers of cellulose than when prior art systems are used.

Other objects of the present invention will be evident to those skilled in the art after reading the description of the invention herein.

In one aspect of the present invention there is provided an impregnated natural fiber. The impregnated fiber includes a cuticle and an interior lumen, the cuticle circumscribing the interior lumen. The impregnated fiber further includes insoluble particulates embedded in the fiber possessing a preselected property. The particulates make up from 0.1% to 30% w/w of the impregnated fiber and the embedded particulates impart their preselected property to the fiber when embedded in the fiber. The particulates are embedded in both the cuticle and within the lumen of the fiber.

In some embodiments, the impregnated fiber has a tensile strength in excess of 36 g/tex.

In other embodiments, the impregnated fiber exhibits an increase in tensile strength after impregnation that is at least 15% greater than the average tensile strength of untreated fibers drawn from the same fiber source as the fiber of the impregnated fiber.

In some embodiments, the impregnated fiber exhibits a micronaire value in excess of 4.85.

In other embodiments, the impregnated fiber exhibits a micronaire value after impregnation at least 20% greater than the average micronaire value of untreated fibers drawn from the same fiber source as the fiber of the impregnated fiber.

In embodiments, the impregnated fiber and yarn formed therefrom still exhibit the preselected property after 100 home washings or 50 industrial washings.

In embodiments, the impregnated fibers and yarn made therefrom still exhibit the preselected property after the fiber has been bleached and optically whitened.

In embodiments, the impregnated fibers and yarn made therefrom still retain particulate material in their lumens after bleaching and optical whitening while the number of particulates from an exterior face of the cuticle of the fiber has been reduced by at least 95%.

In some embodiments the impregnated particulates are present in an amount at least 0.5-20 wt. % of the impregnated fiber.

In some embodiments, the insoluble particulates are nano-sized particulates. Nano-sized particulates encompass particles between 0.1-0.5 microns.

In embodiments of the impregnated fiber, the impregnation of the fiber is effected by acoustic cavitation.

In some embodiments, the impregnated fiber absorbs water at a rate and amount greater than a non-impregnated fiber.

In some embodiments, the impregnated fiber absorbs water uniformly over the length of the fiber.

In some embodiments, pores are formed in the fiber cuticle during impregnation of the fiber.

In some embodiments, the fiber of the impregnated fiber is a cellulose fiber.

In some embodiments of the impregnated fiber, the insoluble particulates are preselected to impart non-ignition or retarded ignition properties to the fiber and are chosen from the group consisting of Huntite ($Mg3Ca(CO3)4$), magnesium hydroxide, alumina trihydrate and combinations thereof.

In other embodiments of the impregnated fiber, the insoluble particulates are preselected to impart antimicrobial properties, including antibacterial and/or antifungal, and/or antiviral properties, to the fiber and are chosen from the group consisting of silver oxides, copper oxides, magnesium oxide, zinc oxide, zeolites, ceramic compounds and combinations thereof.

In yet other embodiments of the impregnated fiber the insoluble particulates are preselected to impart pesticidal properties to the fiber, and are chosen from the group consisting of diatomaceous earth, copper oxides, silver oxides, zinc oxide, and combinations thereof.

In still other embodiments of the impregnated fiber, the insoluble particulates are preselected to impart waterproofing properties to the fiber, and are chosen from the group consisting of ground silica, nano-silica, polysiloxanes and combinations thereof.

In further embodiments of the impregnated fiber, the insoluble particulates are preselected to impart UV inhibiting properties to the fiber, and are chosen from the group consisting of zinc oxide, titanium dioxide and combinations thereof.

In yet other embodiments of the impregnated fiber, the insoluble particulates are preselected to impart medicinal properties to the fiber for transdermal medicinal transport or dermal treatment, and are chosen from the group consisting of copper oxides, silver oxides, encapsulated nano-spheres containing various pharmaceuticals and combinations thereof.

In further embodiments of the impregnated fiber, the insoluble particulates are preselected to impart cosmetic properties to the fiber for dermal treatment, and are selected from a group consisting of copper oxides, silver oxides, benzoyl peroxide and combinations thereof.

In further embodiments of the impregnated fiber, the insoluble particulates are preselected to impart the ability to conduct electricity to the fiber, and are selected from the group consisting of graphene powder and single walled nano-carbon tubes and combinations thereof.

In other embodiments of the invention, there is provided yarn woven from a plurality of impregnated fibers, the impregnated fibers as in any one of the embodiments discussed above.

In other embodiments of the invention, there is provided an article comprised of the impregnated fibers described in any one of the above embodiments. The article is selected from a group consisting of the following classes of articles: wearing apparel; medical and hospital supplies, uniforms, curtains, scrubs, sheets, pillowcases, blankets, slippers, patient gowns, towels and any textile or product made from a textile used in a healthcare environment, an elderly care facility, a public or private institution, or as a domestic product used in the home.

In other embodiments of the invention there is provided an article comprised of yarn woven from the impregnated fibers described in any of the embodiments discussed above. The article is selected from a group consisting of the following classes of articles: wearing apparel; medical and hospital supplies, uniforms, curtains, scrubs, sheets, pillowcases, blankets, slippers, patient gowns, towels and any textile or product made from a textile used in a healthcare environment, an elderly care facility, a public or private institution, or as a domestic product used in the home.

In other embodiments of the invention there is provided an article comprised of a non-woven textile which is made of the impregnated fibers as in any of the embodiments discussed above. The article is selected is from a group consisting of the following classes of articles: wearing apparel; medical and hospital supplies, uniforms, curtains, scrubs, sheets, pillowcases, blankets, slippers, patient gowns, towels and any textile or product made from a textile used in a healthcare environment, an elderly care facility, a public or private institution, or as a domestic product used in the home.

In another aspect of the present invention there is provided a system for producing sliver fibers impregnated with insoluble particulates. The system includes: a conveyor for conveying one or more sliver fiber ribbons; a dispenser for containing a paste on one or more sliver fiber ribbons, the paste comprising: i) one or more insoluble particulate materials possessing one or more preselected properties, ii) a thickening agent and iii) water, and a sonotrode in ultrasonic communication with a transducer for generating ultrasonic waves to be transmitted through the dispensed paste to the one or more sliver fiber ribbons, the ultrasonic waves embedding, the one or more insoluble particulate materials in the one or more sliver fibers.

In another embodiment of the system, the system further includes a wetting bath positioned upstream from the sonotrode for containing a deaerating solution through which the one or more sliver fiber ribbons is conveyed and wetted.

In embodiments of the system, the sonotrode is a bore sonotrode having a plurality of bores. In embodiments of the system, the bores each have a diameter of from 4 mm to 20 mm and a length of from 40 mm to 80 mm. In other embodiments of the bore sonotrode, the bores each have a diameter from 6 mm to 15 mm and a length of from 50 mm to 70 mm.

In some embodiments of the system, the system further includes a constraining device configured for constraining or folding the one or more sliver fiber ribbons. In some embodiments of the constraining device, the constraining device includes a series of constraining rings upstream from the sonotrode. Each of the rings is circular having a diameter smaller than the immediate previous ring in the series when moving in the direction toward the sonotrode. In some embodiments, the ring of the constraining device closest to the sonotrode and upstream from it has an oval shape.

In some embodiments of the system, the system further includes a releasing device configured for releasing the constrained or folded one or more sliver fiber ribbons. In some embodiments of the system, the releasing device includes a series of rings downstream from the sonotrode, each ring being essentially circular and having a diameter larger than the adjacent ring in the series of rings further downstream from the sonotrode.

In embodiments of the system, the conveyor includes a series of non-continuous spaced apart conveyors.

In embodiments of the system, the system further includes a first pair of squeeze rollers wherein the one or more sliver fiber ribbons, after being squeezed by the first pair of squeeze rollers, has enough integral strength to be pulled by a second pair of squeeze rollers over regions where the conveyor is absent.

In embodiments of the system, the one or more insoluble particulate material is selected from a material which includes one or more of an element, a compound, a composition and any combination of the above.

In some embodiments of the system, the system further includes a first container wherein the one or more sliver fiber ribbons is bleached.

In some embodiments of the system, the system further includes a second container wherein the one or more sliver fiber ribbons is optically whitened.

In some embodiments of the system, the system further includes one or more water spraying or rinsing apparatuses for removal of residual thickening agent from the sliver fiber ribbons.

In some embodiments of then system the one or more sliver fiber ribbons is comprised of fibers as described in any one of the embodiments discussed above.

In some embodiments of the system, the one or more sliver fiber ribbons is formed of cellulose fibers.

In some embodiments of the system, the paste includes insoluble particulate material having a 27-33 weight % of the paste, a thickening agent having a 20-36 weight % of the paste, and water having a 31-53 weight % of the paste.

In some embodiments of the system, the thickening agent is selected from a group consisting of nanocellulose, fumed silica, guar gum, algicinic acid and salts thereof, agar, locust bean gum, pectin, and gelatin.

In some embodiments of the system, the thickening agent is nanocellulose.

In some embodiments of the system, the paste has a viscosity of from 650 to 1000 centipoise at room temperature.

In other embodiments of the system, the paste has a viscosity of from 740 to 806 centipoise at room temperature when the insoluble material in the paste ranges from 27 to 33% weight.

In another aspect of the invention there is provided a method for impregnating sliver fibers with insoluble particulates. The method includes the steps of: a. obtaining a paste including: i. one or more insoluble particulate materials having a preselected desired property; ii. water; and, iii a thickening agent; b. providing one or more sliver fiber ribbons; c. dispensing the paste on the one or more sliver fiber ribbons; and d. conveying the paste-coated one or more sliver fiber ribbons through a sonotrode so that ultrasonic waves are transmitted through the one or more sliver fiber ribbons so that the one or more insoluble particulate materials in the paste on the one or more sliver fiber ribbons is embedded in the ribbons, thereby imparting the desired one or more properties of the one or more particulate materials to the sliver fibers.

In embodiments of the method, the sonotrode is a bore sonotrode having a plurality of bores.

In embodiments, the method further includes a step of constraining or folding the one or more sliver fiber ribbons so that it is compressed so that the fibers of the ribbons cannot separate and disperse. In some embodiments of the method, the method further includes a step of releasing or unfolding the constrained or folded one or more sliver fiber ribbons.

In an embodiment of the method, the method further includes a step of contacting a deaerating solution to the one or more sliver fiber ribbons prior to the step of dispensing.

In some embodiments of the method, the method includes a step of washing the one or more sliver fiber ribbon to remove excess paste from the ribbons.

In embodiments of the method, the sonotrode is operated between about 500 W to about 3000 W and between about 15 kHz to about 30 kHz. In yet other embodiments, the sonotrode is operated between about 1000 W to about 2000 W and between about 15 kHz to about 25 kHz.

In some embodiments of the method, the method further includes a step of bleaching and/or optically whitening the one or more impregnated sliver fiber ribbon.

In embodiments of the method, the one or more insoluble particulate materials is selected from an element, a compound, a composition and any combination of the above In embodiments of the method, the resultant impregnated fiber sliver can be used directly for producing yarn without a second carding operation.

In reading the embodiments above, the reader is requested to view them both as separate embodiments and as embodiments that are capable of being combined with other embodiments relating to their class. Thus the multiply dependent claims presented in the Claims section below are all covered in the immediately above summary section. There are three classes of claims being shown in this section: the impregnated fiber, the system for producing the impregnated fiber and a method for producing the impregnated fiber.

BRIEF DESCRIPTION OF THE DRAWINGS

The present invention will be more fully understood and its features and advantages will become apparent to those skilled in the art by reference to the ensuing description, taken in conjunction with the accompanying drawings, in which:

FIG. 7 shows the fibers substantially along their long axis while FIG. 8 shows the fibers cut transversely to their long axis. In the latter, a copper particulate is attached to the fiber in the region of the lumen;

DETAILED DESCRIPTION OF PREFERRED EMBODIMENTS OF THE INVENTION

Figure 1:
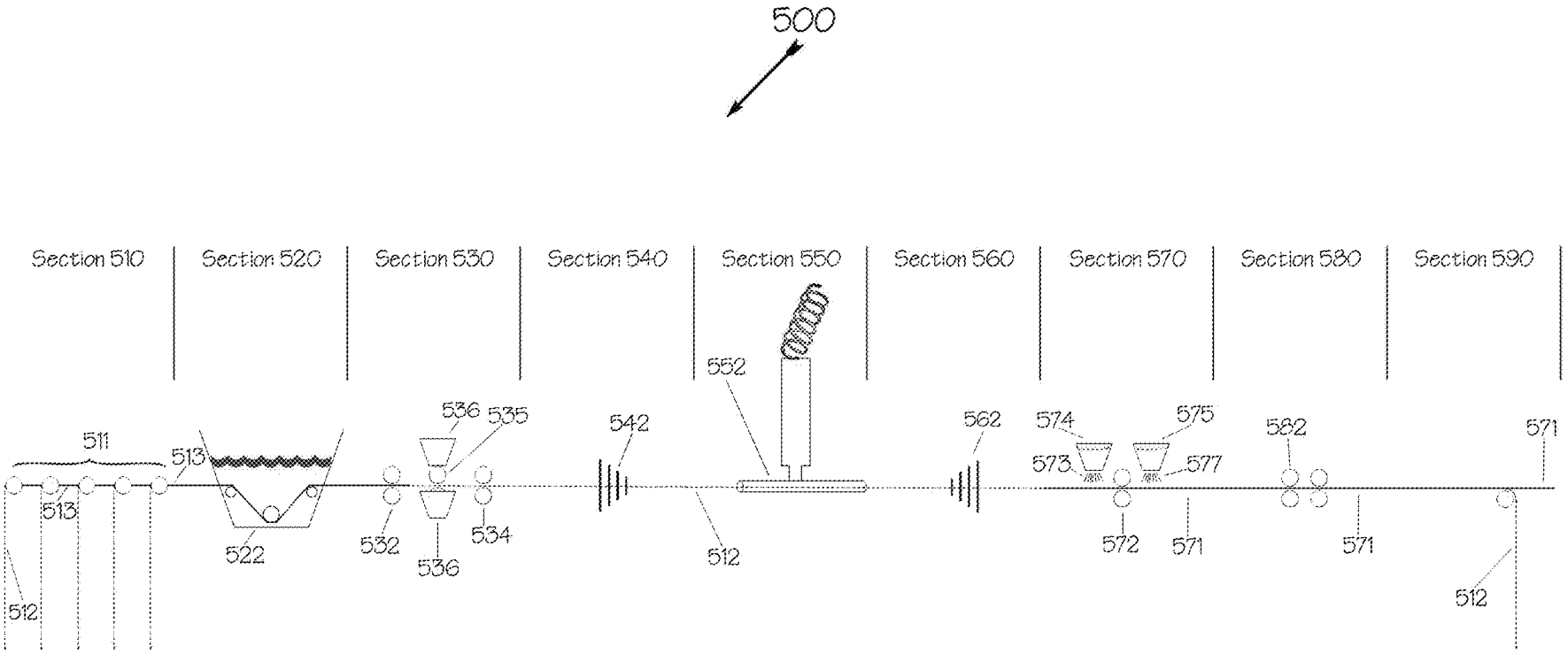
FIG. 1 is a schematic diagram of an embodiment of the system of the present invention.

Before explaining several embodiments of the invention in detail, it is to be understood that the invention is not limited in its application to the details of construction and the arrangement of the components set forth in the following description or illustrated in the accompanying figures. The invention is capable of other embodiments or of being practiced or carried out in various ways. Also, it is to be understood that the phraseology and terminology employed herein is for the purpose of description and should not be regarded as limiting.

It should be noted that throughout this document all data is exemplary. It is used solely to present and explain the invention and as a possible implementation of the invention and is not intended to limit the invention. Similarly, the present invention has been described in relation to particular embodiments which are intended in all respects to be illustrative rather than restrictive.

As used herein "comprising" or "comprises" or variants thereof is to be interpreted as specifying the presence of the stated features, integers, steps, or components as referred to, but does not preclude the presence or addition of one or more additional features, integers, steps, components, or groups thereof. Thus, for example, a method comprising given steps may contain additional steps.

When an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all values within the range. It is also intended to include all ranges within the upper and lower values of the endpoints of the specified range. It is not intended that the scope of the invention be limited to the specific values recited when defining a range.

Definitions of Terms

"Sliver" as used herein is a long bundle of fiber that is generally used to spin yarn. A sliver is created by carding or combing raw fibers, which are then drawn into long strips with the fibers substantially parallel to each other. The fibers are loose and substantially untwisted. Sliver is the stage before which the sliver fibers are given a slight twist which converts them to the next stage of yarn production, the roving stage. known to persons familiar with the art.

"Insoluble" as used herein means a solid material remaining at least partly in particulate form in water, water-based solutions or water-containing solutions.

"Speckled coating" as used herein refers to a discontinuous particulate coating attached to sliver fiber in a random pattern.

"Wet" as used herein with respect to sliver means covered with water, a water-based solution or a water-containing solution or completely saturated with water, the water-based solution or the water-containing solution which drip when held in the hand.

"Moist" as used herein with respect to sliver is synonymous with "damp" wherein the presence of water, a water-based solution or a water-contain[ng solution can be felt, but water does not drip from the sliver when held by a person. In the text herein, when "water" is used it is intended to include water, water-based solutions and water-containing solutions.

"Egg shell white" is used to describe the off-white color of fiber, yarn or textiles that results upon regular bleaching generally using chlorites and/or hypochlorites.

"Snow white" is used to describe the color of a fiber, yarn or textile that has been optically bleached.

"Bleaching" is a step used in cotton processing prior to dyeing or other processing. The material used is typically hypochlorite or chlorite solutions unless optically bleaching is indicated.

"Optical whitening" also known as "optical brightening" or "optically bleaching" is effected by chemical compounds that absorb light in the ultraviolet and violet region (usually 340-370 nm) of the electromagnetic spectrum, and re-emit light in the blue region (typically 420-470 nm) by fluorescence. These additives are often used to enhance the appearance of the color of a fabric and paper, by producing a "whitening" effect. They make intrinsically yellow/orange materials look less so, by compensating for the deficit in blue and purple light reflected by the material. This is effected by the blue and purple optical emission of a fluorophore.

"Embedded", "impregnated", "attached" and variants thereof used with regard to the particulates' position on, or in, the fibers will be used interchangeably herein and should be deemed synonymous unless indicated otherwise. They are not intended to describe or distinguish between the nature of the attachment, chemical or physical, and the precise position of the particulates on the fibers.

"Sonication", "cavitation" and "acoustic cavitation" and derivatives of these terms are used as synonyms without attempting to distinguish between them.

"Upstream of the sonatrode" refers to a location in a system to the side of the sonotrode in the direction of the paste dispenser.

"Downstream of the sonatrode" refers to a location in a system to the side of the sonotrode in the direction of the dryers and the final storage containers.

"Deaerating agent" is a chemical agent that wets particulates and defoams the particulate water slurry formed when the paste discussed herein is mixed.

"Particulates" and "particles" are used herein interchangeably without any intention to distinguish between them.

"Nano" is used as a prefix herein for sizes no larger than 0.5 micron and no smaller than 0.1 micron.

"Natural fibers" are used herein to denote non-synthetic fibers.

The present invention discussed herein provides a system and method for protecting the integrity of the parallelism of natural fiber within a sliver bundle. Typically, but without intending to limit the invention, the natural fibers discussed herein are cellulose fibers. Cellulose fibers in sliver form, while originally substantially parallel to each other tend to disorder and disperse when sliver is introduced into a liquid. This disordering/dispersing phenomenon is exacerbated when the cellulose sliver is subjected to highly energetic acoustic cavitation in a liquid medium. Instead of subjecting the cellulose sliver to acoustic cavitation in a liquid bath, a damp paste is used herein. Without being bound by any particular theory, it may be that the damp paste contains sufficient water to allow transmission of the acoustic waves, without dispersing and disordering the sliver fibers.

The paste is dispensed onto the sliver prior to cavitation. Since the particulates being embedded are present in the paste, the particles are positioned in close proximity to the sliver. As a result, a larger number of particulates may be embedded in the sliver fibers when a sonotrode is activated than in other sonication methods when the particulates are placed in water. Since no liquid medium is used in the present invention and the sliver fiber ribbon passes through a bore of a bore sonotrode for a relatively short period of time, and at a very short distance from the source of the ultrasonic waves used, more particulates are embedded with less disordering and dispersal of the fibers than under other acoustic cavitation methods known in the prior art. A greater concentration of total particulates is embedded within the sliver fibers, when using the present system than when using prior art systems.

The method as described herein is different than previously disclosed acoustic cavitation systems. Moreover, other sonication systems and methods when surface treating textiles typically treat fabrics and/or yarn, not fibers.

The particulates when embedded impart at least one additional desired property to the fibers such as, but not necessarily limited to, anti-microbial, acaricidal, fire retardancy, pesticidal, insecticidal, and cosmetic properties. Yarns, and even later stages in textile processing such as fabrics, made from the treated fibers, also exhibit the added desired property.

The system and method allow for the treatment of fibers and their conversion into yarns without requiring a second carding step after completion of impregnation of the fibers with the particulate material. This is particularly important when cellulose fibers are used. As known to persons skilled in the art, because of sliver fibers' light weight and airy/fluffy nature, particularly cellulose sliver fibers, they cannot be placed in water without fiber dispersal. Therefore, it would be expected by persons skilled in the art that sliver fibers cannot withstand exposure to the energetic ultrasonic waves generated in an acoustic cavitation process. Carded, parallel oriented sliver fibers, especially cellulose fibers, such as cotton fibers formed into sliver, lose their parallelism when exposed to water with or without use of ultrasonic waves. Maintaining their orientation in an oriented bundle throughout processing is difficult. The present system and method using a bore sonotrode and a paste including A. an insoluble material with at least one desired property to be imparted to sliver fibers, and B. a thickening agent with a minimal amount of water overcome these difficulties.

In summary the present invention provides the following new features:

There is no need for a liquid bath during acoustic cavitation of the fibers as in prior art. This lessens the possibility of sliver fiber dispersal and disorder, thereby obviating the need for an additional carding step.

A damp paste comprising an insoluble particulate material that possesses a desired property and a thickening agent in a small amount of water is dispensed directly onto the top and bottom of a moist sliver fiber ribbon. This reduces the distance that the material with the desired property must travel before being embedded in the fibers. It allows for a greater amount of the material to enter the fiber.

A bore sonotrode is used wherein the acoustic waves are generated in close proximity to the fibers being impregnated. The fibers pass through a bore of the sonotrode. This reduces energy losses and allows for more particulates or other embedded material to enter the fibers. Particulates are embedded in the outer surface of the cuticle of the cotton fiber and surprisingly also within the lumen of the fibers. This results in the treated fibers (and yarns, fabrics and articles made therefrom) being able to undergo more industrial or home washings without a significant reduction in the desired property imparted by the impregnated material.

The system contains a constraining device for constraining one or more sliver fiber ribbons preventing fiber dispersal and loss of parallel orientation while being sonicated.

The treated fibers demonstrate tiny perforations after cavitation which allow for a higher porosity of water into the fibers.

The treated fibers demonstrate an increase in their micronaire ratings.

The treated fibers demonstrate an increase in their tensile strength.

The treated fibers provide for easier production. Since the original parallel sliver fiber orientation is maintained during processing, there is no need for subsequent reconstitution of the sliver fiber orientation by use of a carding machine.

The use of a bore sonotrode having at least one bore allows for increased production capacity in kilos per hour for treating sliver fiber.

A. System for Treating Fibers

Reference is now made to FIG. 1 in which a schematic diagram of an embodiment of a system 500 of the present invention is shown.

The description herein will be discussed in terms of cotton sliver fibers but the description should be understood to apply to other types of natural sliver fibers as well. This includes, both cellulose and non-cellulose natural fibers.

The system will be discussed in terms of insoluble particles as the material being embedded.

In normal manufacturing, raw cotton is cleaned, opened and then carded. The process of carding brings the fibers into an airy/fluffy sliver state where the fibers form bundles and the fibers are substantially parallel to each other. However, carding also shortens and destroys fibers. Because carding is so harsh on fibers, it is desirable that carding of fibers is performed only once during the processing discussed herein.

System 500 has sections 510, 520, 530, 540, 550, 560, 570, 580 and 590. Section 510 has a container set 511. Sliver fibers 512 (dashed lines), as shown in FIG. 1, are introduced from at least one container of a container set 511 to a single moving closed-loop conveyor 513. In FIG. 1 the entire closed loop is not shown. Section 520 has a wetting bath 522. The conveyor 513 brings the sliver to wetting bath 522 and is discontinued once the wet slivers pass through a first set of squeeze rollers 532, in section 530.

In FIG. 1, five sliver ribbons 512 each from a different container constituting container set 511 are shown. It should be understood that more than or fewer than 10 containers can form container set 511. In other embodiments of system 500, any number of sliver fiber ribbons 512 from 2-30 can enter into the cavitation mechanism (sonotrode) 552 at once. The exact number that can be used is determined by the number and size of the bores in the sonotrode(s) used and the width of the ribbons. In theory, any number of sonotrodes and an equivalent number of transducers can be added to section 550 of system 500 illustrated in FIG. 1. It should readily be understood that since each sonotrode has a plurality of bores it can handle several sliver ribbons at one time.

In the discussion herein "sliver" in the singular may, at times, be used. However, it is to be understood that the use of the singular form may also relate to a plurality of sliver bundles or ribbons unless specifically indicated otherwise.

Without intending to limit the invention, the conveyors used in system 500 can include a single web that can be folded so as to trap the sliver within its folds while transporting the sliver fiber ribbon. Alternatively, it can be a double web, i.e. top and bottom webs, which hold the sliver fiber ribbon in place between the webs. Other types of conveyors may also be used, provided that they can contain the sliver fiber ribbons and prevent them from dispersing and disordering. The conveyor may be made of various materials, for example rubber, flexible plastics or stainless steel mesh.

In FIG. 1 what is described in system 500, as sliver fibers 512, or moist sliver fiber ribbon, or paste coated moist sliver fiber ribbon, or paste coated ribbon or other similar descriptors, generally lie on conveyor 513 which starts in section 510 and guides the sliver through wetting bath 522 in section 520. Because of the excessive crowding of the other elements present, the sliver (dashed line) is not depicted separately when it is positioned on conveyor 513. It should be clear to persons skilled in the art that the sliver is physically distinct from the conveyor despite not being explicitly shown as such. As will be described, the conveyor system is not necessarily continuous at several points in system 500, imparting a degree of modularity to system 500 as a whole.

Reference is now made to sections 510 and 520: The previously carded sliver fibers exiting from the containers (not shown) comprising container set 511 are conveyed on a conveyor 513, typically but without limiting the invention, a double web, which transports the sliver through wetting bath 522 in section 520, the wetting bath wetting the fibers. The fibers then are pulled out of bath 522 and advanced to squeeze rollers 532 of section 530. The conveyor 513 described in section 510 and 520 forms a loop (not shown) in these two sections and does not continue into section 530 past rollers 532.

Wetting bath 522 is filled with water and a surfactant, for example, but without intending to limit the invention, Triton X, such as that obtainable from Merck Ltd., Rechovot, Israel or Agan Chemical Corporation Ltd., Ashdod, Israel or a deaerating solution such as that sold under the name Biotex DH300 from B & E Chemicals, Ltd. of Rishon LeZion, Israel. Both surfactant and/or deaerating agents allow for better wetting of the sliver. The preferred chemistry is a deaerating agent for reasons discussed herein. It should be noted that other deaerating agents may also be used.

Reference is now made to section 530. After squeezing the sliver fiber ribbon(s) by squeeze rollers 532, most of the water is removed and the parallel cotton sliver fibers form a flat, moist sliver fiber ribbon. Once the sliver goes through squeeze rollers 532 the squeezed sliver changes. It is transformed from an extremely weak ribbon, where the sliver ribbon fibers are only with difficulty kept parallel, to a ribbon having enough structural integrity to retain the t parallel orientation of the sliver fibers without being conveyed by a conveyor. The damp ribbon is strong enough to maintain its structural integrity when pulled by squeeze rollers 534. Because of the structural integrity no conveyor is needed or shown after rollers 532 as discussed below.

Squeeze rollers 532 are configured to be rotated by a motor and pull the sliver out of bath 522 in section 520. Rollers 532 remove excess water from the sliver ribbon in section 530. The moist sliver fiber ribbon now passes through a set of soft rollers 535 which delivers chemistry from paste dispenser 536 in the form of a thick paste on both the top and the bottom of the sliver ribbon. The sliver then proceeds to the second set of mechanized squeeze rollers 534 whose purpose is to force the thick paste into the sliver itself and to ensure that the paste is in contact with the internal surfaces of the sliver and not only on the easily viewable surfaces of the sliver. It will be appreciated by persons skilled in the art that paste dispenser 536 may take any of several possible forms. No single form, configuration or construction is being specifically suggested.

Dispenser 536 contains a paste 538 having thickening agent in a small amount of water and insoluble particulates in water. The paste 538 is added slowly and continuously from dispenser 536 and coats the moist sliver fiber ribbon passing through rollers 535. The particulates impart a preselected property to the sliver fibers when they are embedded in, or otherwise attached to, the fibers. The thickening agent used can be selected from, for example, but without intending to limit the invention, nanocellulose, fumed silica, guar gum, algicinic acid and salts thereof, agar, locust bean gum, pectin, gelatin and others.

The thickener acts to:

1. Assist in bundling the sliver so that when it is exposed to the ultrasonic waves, the sliver fibers essentially retain their parallel orientation and do not disperse; and 2. Assist in attaching the particulates to the fibers so that the particulates don't have to travel far and lose energy before reaching and being attached to, or in, the fibers.

The thickening agent must be one that can be completely rinsed out of the sliver at the completion of sliver processing. If the thickening agent remains on the fiber it will effectively prevent spinning of the fiber during later processing.

The paste is viscous and prepared as a 10-50% w/w suspension of preselected particulates in water. The preferred percent weight ratios of the suspension is 27-33% particulates, 20-36% thickener, typically nanocellulose and 31-53% water. While a 10-50% w/w suspension of selected particulates in water may be used, 20-40% w/w is preferable and even more preferable would be 25-35% w/w. The thickener of choice is nanocellulose as it, among other things, increases the rate of water absorption of water-based solutions into the cellulose. When other thickeners are used, such as fumed silica, larger amounts of thickeners may be required.

Example 1

A suitable paste was made from water 45% by weight of the paste, nanocellulose 25% by weight of the paste; and $Cu_2O$ 30% by weight of the paste.

The components were mixed and used at room temperature.

Example 2

Viscosity of the paste was determined at an accredited lab in Israel whose test results are accepted by the Israel Ministry of Health. A Brookfield rotation viscometer was used and the method for determining the viscosity is generally as described below.

The following pastes were prepared as in Table 1A immediately below:

TABLES 1A

| | Cu2O | Nano cellulose | Water |
|---|---|---|---|
| | | 27% ground Cu | |
| % | 27 | 36 | 37 |
| Kg | 0.054 | 0.072 | 0.074 |
| | | 33% ground Cu | |
| % | 33 | 33 | 34 |
| Kg | 0.066 | 0.066 | 0.068 |

Results of the viscosity measurements are presented in Table 1B which follows:

TABLE 1B

| % Cu2O | Type of Test | Results | Units | Method |
|---|---|---|---|---|
| 27% | Viscosity | 806 | Cp at 25° C. | Brookfield |
| 33% | Viscosity | 740 | Cp at 25° C. | Brookfield |

For the measurement on the 27% copper oxide sample the following equipment was used: Brookfield DV-1+ viscometer, Brookfield RV-3 Spindle and 50 RPM.

For the 33% copper oxide sample, the following equipment was used: Brookfield DV-1+ viscometer, Brookfield RV-3 Spindle and 100 RPM.

Figure 2A:
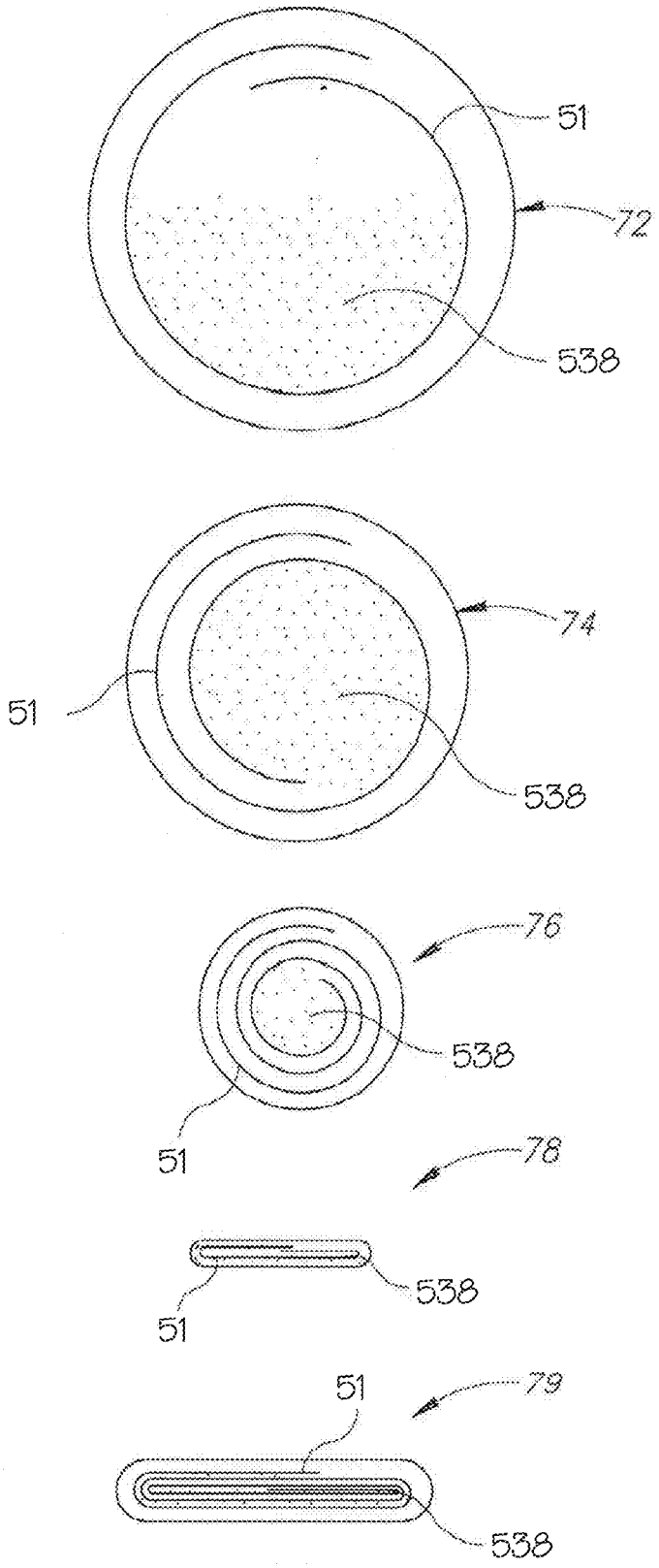
FIG. 2A is a head-on view of the constraining rings in one embodiment of the constraining device in the system of FIG. 1.
Figure 2B:
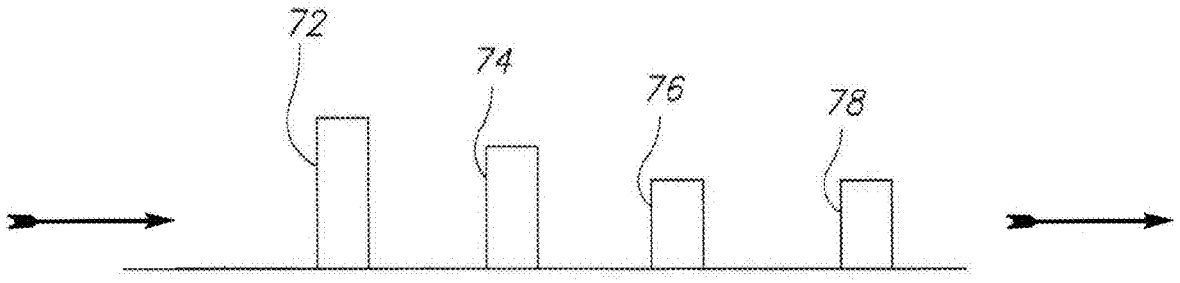
FIG. 2B is a side view of the constraining rings in FIG. 2A.

Reference is now made to constraining section 540, which has a constraining device 542 upstream of sonotrode 552. The sliver enters constraining section 540 comprising constraining device 542. In the present embodiment, constraining device 542 comprises a plurality of constraining rings. The diameters of the constraining rings vary. The diameter of the rings furthest from sonotrode 552 are largest, while those closest to sonotrode 552 are progressively smaller. The ring of constraining device 542 closest to sonotrode 552 may be oval-shaped while the other rings may be substantially circular, as shown in FIGS. 2A and 2B. The rings constrain the moist sliver ribbon providing a thicker sliver ribbon. In some embodiments, for example when a double web conveyor is used, there may be no need for the constraining device (and releasing device described below).

It should be evident to persons skilled in the art that other constraining or folding devices other than those described herein can also be used.

Reference is now made to section 550. The constrained thickened sliver ribbon enters into a bore (not shown) of a bore sonotrode 552 and is exposed therein to ultrasonic waves.

Figure 12B:
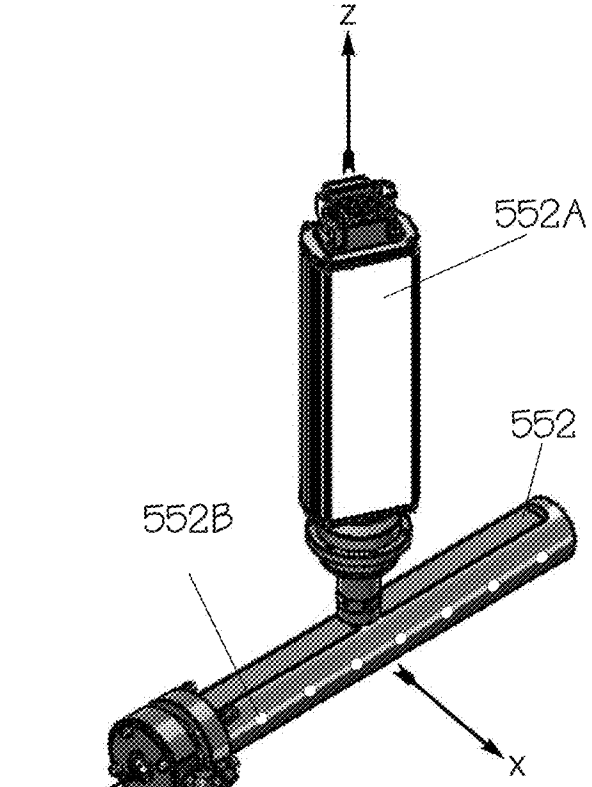
FIGS. 12A-12B show two perspective views of a bore sonotrode that may be used with the system of the present invention.
Figure 12A:
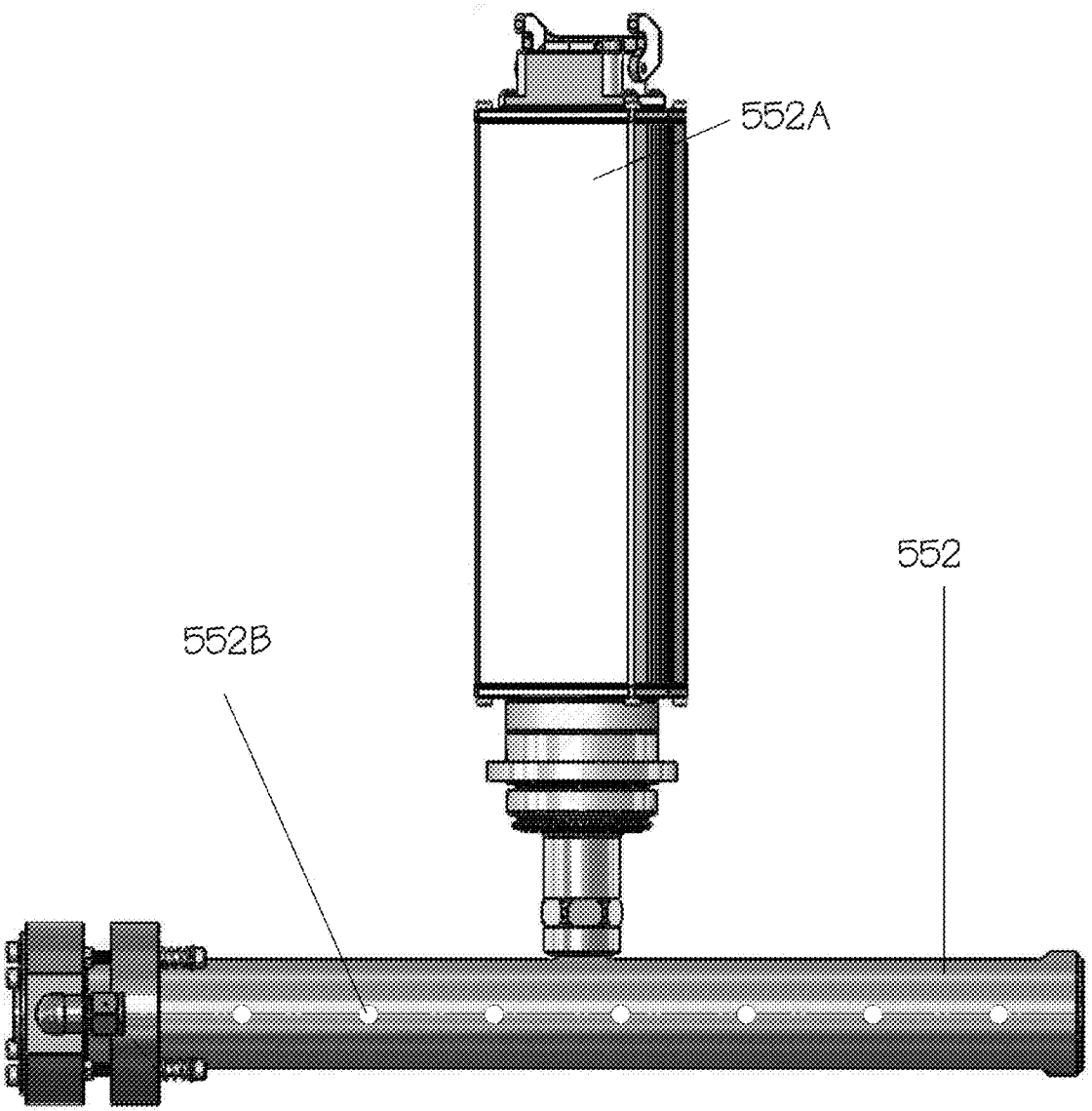

FIGS. 12A and 12B, to which reference is now made, show two perspective views of an acoustic cavitation system including a bore sonotrode and transducer configured to be suitable for impregnating sliver fibers as discussed herein. FIG. 12A shows the sonotrode in sonic communication with the transducer 552A generating the ultrasonic waves. Sonotrode 552 shows a plurality of bores 552B through which sliver fiber ribbons are pulled and sonicated. A suitable sonotrode and transducer may be obtained from Hielscher Ultrasound Technology, Teltow, Germany. Other sources for ultrasonic apparatuses are also available. Direction x of FIG. 12B indicates the direction of the moving sliver fiber ribbons transiting through the sonotrode's bores.

Reference is now made to FIG. 1 section 560, having a releasing device 562. After exiting bore sonotrode 552, the constrained thicker sliver ribbon is released by releasing device 562 and returned to its initial released state.

In the present embodiment, releasing device 562 may be comprised of a plurality of releasing rings. The releasing rings are positioned in a sequence according to increasing diameter when moving away from the sonotrode on its downstream side. The ring closest to sonotrode 552 has the smallest diameter and the ring furthest from sonotrode 552 has the largest diameter. When released by the releasing device the sliver ribbon returns to its initial released state.

It should be readily apparent to persons skilled in the art that other types of releasing devices may also be used with system 500.

In some embodiments, there may be no need for a releasing device and the constrained ribbon releases itself when not constrained. No user or system 500 intervention is required.

After the sliver is released it passes through at least one more pair of squeeze rollers (not shown) to remove most of the remaining water before entering section 570 of the system. The released sliver is then placed on a web 573 and rewetted with a water spray for cleaning.

Reference is now made to section 570. The sliver ribbon is then conveyed to a conveyor 571 in section 570 where it is exposed to a spray of water 573 from spray bins 574. A set of mechanically driven squeeze rollers 572 transports conveyor 571 that has the sliver on or in it to another spray of water 577 from spray bins 575 for a second washing. After the two washings in Section 570 essentially all the thickening agent on the fibers has been removed.

It should be understood that if more washings are needed to rid the ribbon of all of the thickening agent, more spray bins may be added. Any residual thickening agent may interfere with further processing of the fiber and yarn made from the treated fiber.

Reference is now made to section 580. Conveyor 571 conveys the sliver fibers into section 580. There the fibers pass through a series of heated rollers 582 which dry the fibers. Other drying elements may be used in system 500, for example hot air ovens.

Reference is now made to section 590, wherein packing of the treated sliver fibers is performed. Conveyor 571 continues to this section but turns back in its loop (not shown). The fibers are then pulled by squeeze rollers (not shown) after which they are deposited in storage containers (also not shown).

It should readily be understood that the number of bath squeeze rollers, heating rollers, conveyors and washing apparatuses may vary in system 500. This variability depends on the chemicals, paste and processing variables used. It also depends on the need at various stages of the process to minimize water content and/or to pull the sliver ribbons with rollers when no conveyor is present.

There is little change in the parallel orientation of the sliver fibers treated in system 500 relative to the parallel orientation of the fibers before treatment. Accordingly, the dried, treated sliver fiber ribbons produced in this system do not require being passed through a carding machine to return disordered sliver fibers to their original parallel state. The treated fiber can proceed to the yarn production stage without requiring a second carding step. As noted above, only substantially parallel sliver fibers are sufficiently workable, stretchable and spinnable needed for subsequent processing.

Not shown in FIG. 1 is the possibility of adding two additional baths to system 500, one bath for bleaching and one bath for optical whitening of the treated sliver fiber ribbons. These operations are discussed at greater length below. Additional washing and drying stations could be added if bleaching and optical whitening operations are contemplated.

Reference is now made to FIGS. 2A and 2B. The paste-coated sliver ribbon produced in Section 530 of FIG. 1 as described above is then put through an exemplary constraining device 542 shown in Section 540 of FIG. 1. The constraining device may comprise a plurality of constraining rings (72, 74, 76, 78) as shown in FIGS. 2A-2B. These rings are arranged from larger diameter rings to smaller diameter rings when moving toward the sonotrode. The arrows in FIG. 2B indicate the direction of travel of the sliver in the constraining rings.

It can readily be understood that in other embodiments of the system, it may be possible to fold a flexible conveyor in half along its long axis. The paste coated sliver(s) can be positioned on the folded conveyor which envelops the paste coated sliver ribbons ensuring that the sliver fibers remain parallel to each other until brought to the bore holes of bore sonotrode 552.

It should be evident to persons skilled in the art that yet other types of constraining and folding devices may also be used and that a constraining device may be comprised of elements other than the constraining rings discussed above.

FIGS. 2A and 2B to which reference is now made, shows the series of constraining rings (72, 74, 76, and 78) used as the constraining device 542 in system 500. In FIG. 2A, each constraining ring is seen head-on. Each constraining ring comprises an ring surface 51 encompassing a cavity 538 through which sliver is introduced It should be noted (see FIG. 2A) that the last constraining ring 79, located closest to sonotrode 552 may be oval-shaped whereas all previous ones are substantially circular. As a result, the paste-coated sliver fiber ribbon 572 emerging from element 79 is oval-shaped. This allows the constrained sliver ribbon to more easily pass through the bores of the sonotrode.

The constrained sliver ribbon is then conveyed directly into sonotrode 552 whose configuration is different from sonotrodes described in other textile impregnation documents. In the present invention, a bore sonotrode (see FIGS. 12A-12B also discussed above) is used were the sliver fiber ribbon does not travel through water. In previous textile cavitation documents a flat (square or rectangular) or semi-circular sonotrode is used which operates in water.

It should be noted that in contrast to prior art textile/acoustic cavitation systems, a water bath is not used to cavitate the fibers in the present invention. Without being bound by the following theoretical explanation, it was surprisingly found that a) the small amount of water retained in the moist cotton sliver ribbon after passing through squeeze rollers that exert a pressure of about 1 to about 1.5 bars and b) the small amount of water in the paste discussed previously was enough to facilitate ultrasonic wave transmission allowing cavitation of the particulates.

The constrained oval-shaped sliver ribbon exiting ring 79 in FIG. 2A moves through bore sonotrode 552 without using a conveyor. The maximum amount of sliver fibers that can be used is an amount that can "plug" the bore. The bore is typically between 3 mm to 30 mm in diameter which is generally suitable for between 4 and 15 sliver ribbons. A typical bore sonotrode can have anywhere between 1 and 8 bores with the bore length ranging from between 20 mm and 100 mm, more typically from 20 to 50 mm.

As opposed to the technology used in other prior art documents, there is no conveyor at the stage when the sliver is exposed to the ultrasonic waves of the bore sonotrode. In fact, in system 500 of FIG. 1 there is no conveyor between rollers 532 and washing bin 574. In other embodiments persons skilled in the art may design a system where there can be a conveyor in this gap.

In the past, exposure times of the sliver to the ultrasonic waves were up to 14 seconds per meter while the exposure time in the configuration of the present invention is typically between 0.5 and 2 seconds per meter. It was found that the exposure time should not be more than 2 seconds per meter with a 1 second per meter exposure time producing the most satisfactory results. Longer exposure times run the risk of the ultrasonic waves ejecting particles which have only partially become embedded/attached on or in the surface of the fibers.

Because the sliver fibers pass much closer to the sonotrode than in previous acoustic cavitation applications, energy loss is minimized. Because of the small amount of water used, and the fast transit time of the constrained sliver through the bore of the sonotrode, there is very little disturbance to the oriented fibers in the ribbon by the ultrasonic waves.

In addition to a sonotrode with more than a single bore, the sonotrode 552 used herein is positioned perpendicular (y-axis in FIG. 12B) to the length of the sliver ribbon (x-axis in FIG. 12B). The ribbon advances in the direction of the x-axis. The bore's length is short so that sonication occurs at a single region for each bore and not at a plurality of regions on the ribbon. The latter is not the situation when other sonotrode configurations are used since they are positioned essentially parallel to the length of the ribbons.

It should be noted that the amount of particulates embedded by acoustic cavitation on the outside and the inside of the sliver fibers in its ribbon configuration is dramatically increased over previous attempts at particulate impregnation of sliver fibers. This is readily seen in FIGS. 10 and 11 to which reference is now made. Among other things, this dramatic increase in particulate impregnation allows for a larger kill percentage in bacterial testing when antimicrobial particulates are used.

Figure 10:
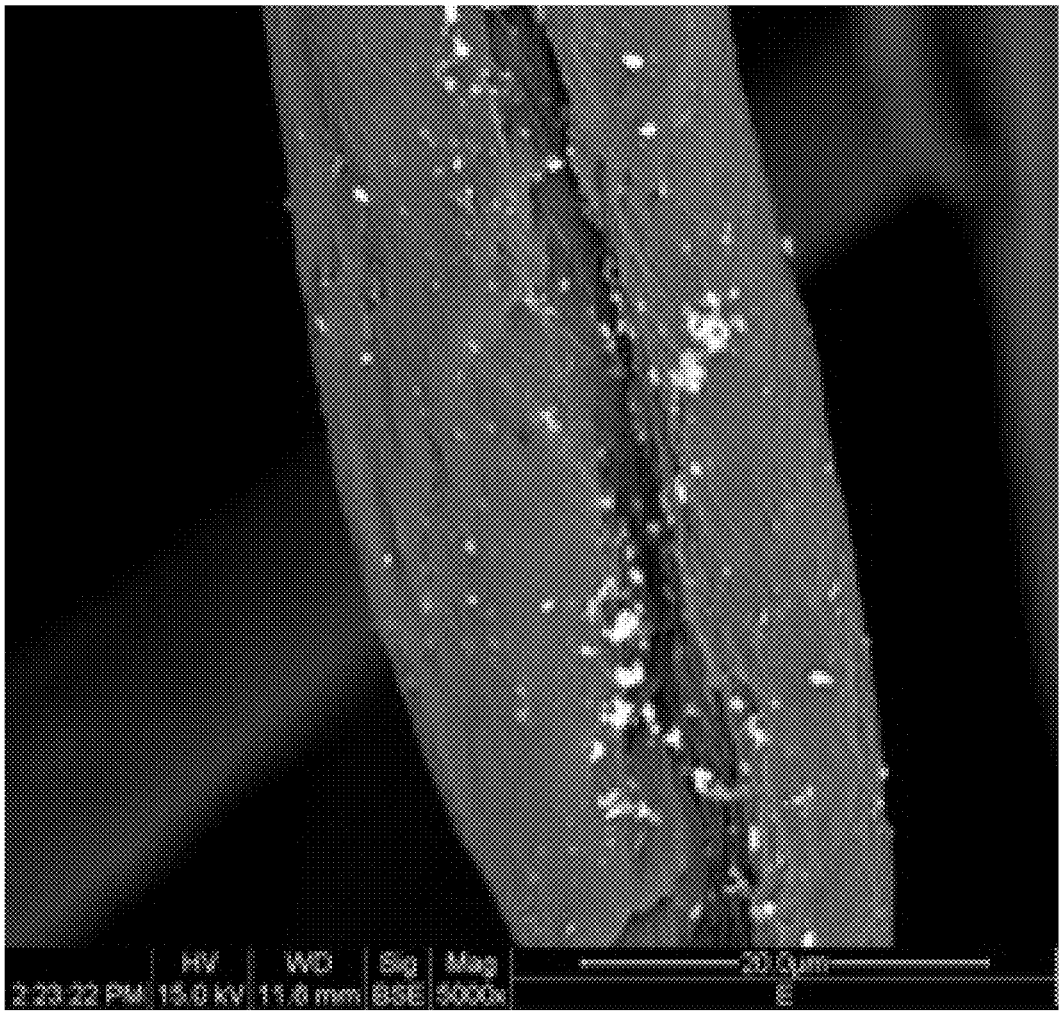
FIG. 10 is a SEM photograph of cotton fibers that have been treated with 3% DH 300/water solution and then cavitated with copper oxide, showing particulates in the lumen.
Figure 11:
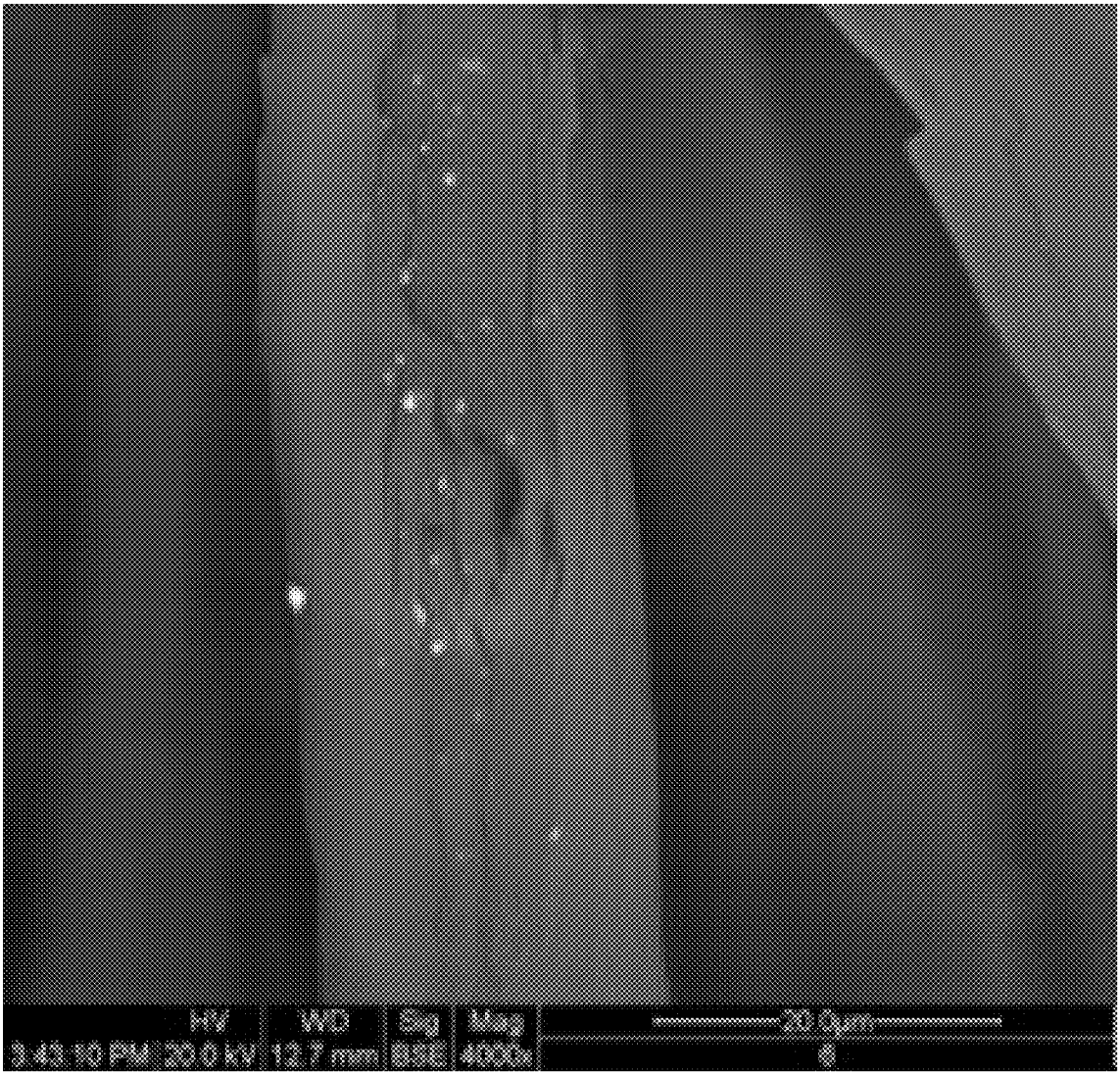
FIG. 11 is a SEM photograph of cotton fibers that have been treated with 3% DH 300/water solution and then cavitated with copper oxide and then bleached and optically whitened as described herein, showing that the lumen contains particulates even after the bleaching and whitening processes have been performed.

When the anti-microbial particulates plus water were introduced into the sliver being treated by system 500 described herein above, fabrics made from the treated sliver fibers exhibited a 4 log reduction of *E-coli* bacteria in 120 seconds. Using the system described in U.S. Pat. No. 9,995,002 it took two hours to obtain the same 4 log reduction. Testing of microbe reduction was carried out by GVP Laboratories, Ltd. of Jerusalem using AATCC (American Association of Textile Chemists and Colorers) Test Method 100-2017. It was observed that not only did the fibers show more particulates covering the outside of each fiber as indicated by the greater degree of speckling in FIG. 10 than in FIG. 9, but it was also found that a large number of particulates were embedded inside the lumen of the fiber, as indicated in FIGS. 10 and 11. See discussion below for further details regarding the photographs in FIGS. 10-11.

It was also found that if speckled cotton fibers containing reddish-brownish copper oxide particulates were bleached using standard textile bleaching techniques and then optically whitened using conventional techniques, the dark color of the copper oxide was not visible to the naked eye and the treated fibers had a white appearance.

One familiar with the art would know that the whitening of fibers, and/or yarns and fabrics, containing embedded copper oxide particulates initially beige/brown in color, is a two-step process. The first bleaching stage generally requires a bath of approximately 10% sodium hypochlorite or sodium chlorite solution in water. The fibers are allowed to soak at 90° C. for 20 minutes in this bath. The agents used for this first bleaching step can be products such as Brightener Next available from B&E Chemicals Ltd. in Rishon LeZion, Israel. Generally, such a bath will remove the loose copper particles which are mechanically held on to the outer surface of the fibers. After rinsing the bleach off of the fibers, the fibers appear as an egg shell white color.

To obtain a snow white color the fabrics then undergo a whitening stage and are then soaked in a whitening bath comprised of 1.5% optical whitener and 98.5% water at 90° C. for 15 minutes. An optical whitener such as BioBlanc BE available from B&E Chemical Ltd. in Rishon LeZion, Israel can be used. The product obtained after these bleaching and whitening processes is optically white in appearance, much like a standard sheet of paper.

The subsequent fibers are snow white in appearance but as can be seen in FIG. 11 they actually contain a large amount of copper oxide below the surface and within the lumen of the fiber. In FIG. 11 the fiber was bleached and optically whitened. It was found to contain no less than 500 ppm of copper oxide in each of four 5 gram samples of bleached and whitened copper oxide tested. Generally, to be an effective bactericidal agent no less than 50 ppm of copper oxide is required.

The snow white color, which is the appearance of the fibers after normal bleaching and optical whitening, indicates that the external speckled copper oxide particulates were removed. The removed copper oxide particles collected at the bottom of both the sodium hypochlorite solution bath and the optical whitener bath. The lack of copper oxide on the fiber's outer surface can be observed visually, with an optical microscope or, for greater clarity, with a SEM photo as in FIG. 11.

However, even after the optical whitening which removed substantially all the surface particles, it was surprisingly noted that the fibers still possessed a high level of antimicrobial activity. (See below) Apparently, copper oxide still existed within the cuticle and in the lumen of the cotton as demonstrated below. See Examples 3 and 4 below for an example of bleaching and optical whitening.

The copper oxide found within the cuticle of the fibers i.e. the lumen, when exposed to water, was still active and the level of its antimicrobial efficacy was unimpaired. In addition, it was found that even after 100 home washings or 50 industrial washings, these fabrics were found to still kill 99% of the bacteria on the fabric as discussed below in conjunction with AATCC Test Method 100-2012 which was used. The test was done at Manufacturing Solutions Center, Conover N.C., USA and demonstrated that a fabric after bleaching, optical whitening, dyeing and 100 home washings or 50 industrial washings carried out in accordance with 2003 AATCC Standard Reference Liquid Detergent WOB, still provides a kill rate of 99% when bacteria are placed on the fabric's surface as determined by AATCC Test Method 100-2012.

FIG. 11, discussed above, is a SEM photograph where the cotton fiber has been burned open by the probe of a SEM. The presence of copper oxide inside the fibers is seen and also attested to by X-ray fluorescence (XRF) data. The latter measures the amount of copper oxide inside the fibers. Therefore, even though the paste containing particulates, was placed only on the surface of the fiber ribbon, when the fibers were examined after exiting the bore of the sonotrode it was found that the particulates had at least partially been embedded within the lumen of the fibers.

The following is an example of the treatment of sliver fibers using system 500.

Example 3

Cotton sliver fibers were placed on a system like that shown in FIG. 1. The sliver was conveyed at a rate of from 0.5 to 1.5 m/sec.

The fibers were conveyed through a wetting bath kept at 40° C. containing deaerating agent DH300 at 1-3% w/w % with deionized water. The sliver fibers transited the wetting bath in 30 seconds to 1 min. Persons familiar with the art would know that the dwell times must be coordinated with then cavitation time which is the most rapid step.

After squeezing out excess water, the damp sliver fibers were conveyed to a paste dispenser where both sides of the sliver ribbon were coated with paste. The paste contained copper oxide/water/thickening agent in weight ratios of 22-27%/45-55%/18-25% respectively. The thickening agent used was nanocellulose, prepared as in Example 1. The paste was dispensed on the moist sliver ribbon for 1 min. It has been observed that that amount of time can be reduced to coordinate with the cavitation time the most rapid step.

The paste-coated sliver ribbon was advance to a bore sonotrode and passed through a bore of the sonotrode where the coated sliver ribbon was subjected to ultrasonic waves for one second. The sonotrode was operated at 700-750 W and 20 kHz.

The sliver ribbon was brought to a washing system where it underwent a hot water (60° C.) shower. It was then subjected to a first bath for between 1-2 mins but the time could be reduced through the use of a surfactant. The bath was kept at 70° C. and contained a solution of Polywash 172 soap (15 g/L)/hot water/DH300 (1 g/L). The sliver was then transferred to bath 2 kept at 90° C. and which contained hydrogen peroxide (8-15 g/L)/hot water/DH300 (1 g/L). The sliver then was transferred to bath 3 held at 70° C. which contained Polywash 172 soap (5 g/L)/hot water/DH300 (1 g/L). The dwell time of the sliver was 1-2 minutes in each of baths 2 and 3 but as above the time can be reduced. In all 3 baths there were up and down rollers. To complete the washing process, the sliver underwent a second shower with the water temperature kept at 50° C.

The sliver ribbon was dried in an oven for 5-15 minutes at 100-300° C.

This was followed by bleaching the sliver ribbon at 50° C. for 10 minutes. The bleaching solution contained (5 g/L) Bioblanc, hydrogen peroxide (8 g/L), Biotex DH 300, at a concentration of 2% in water. A milliliter of brightener was added to the above bleaching solution and heated to 90-95° C. for 20 minutes. The fibers were then washed with soap and water and given a final water rinse.

Optical bleaching was then effected using 1.5 g/L of sodium hyposulfite dissolved in deionized water. The fibers were added to the solution and heated at 60° C. for 15 minutes. The fibers were then washed with soap and water and followed by a rinse in water kept at room temperature. The fibers were than dried in an oven at 100-130° C. for 5-15 minutes.

Example 4

The following XRF analyses were carried out on an average of 4 impregnated fiber samples produced by the system discussed herein (see Example 3 for the method of producing the sample) and by the older system described in U.S. Pat. No. 9,995,002. The first set of tests were carried out before washing, bleaching and optical whitening. A second set of tests was carried out exactly as in the first set of tests above but after washing, bleaching and optical whitening of the fibers. The latter procedures appeared to remove a substantial portion of the copper oxide from the exterior surface of the fibers i.e. the cuticle, regardless of the system producing the impregnated fibers. See below for the XRF and ICP data.

The results of the tests were measured on an X-Ray Fluorescence (XRF) instrument produced by Xenomatics Ltd. of Migdal HaEmek, Israel with confirmation of the results performed using an Inductively Coupled Plasma Mass Spectrometer (ICP) system at Aminolabs, Ltd. in Rechovot, Israel. Each test was conducted in triplicate.

The two systems, XRF and ICP, are two very different methods that are able to determine the quantity of various compounds in a given amount of cotton fibers, in this case 5 grams of sonicated sliver fibers. ICP is a type of mass spectrometry which is capable of detecting metals and several non-metals at concentrations as low as one part in 1015 on non-interfered low-background isotopes.

The XRF results shown below are the average weight of particulates in parts per million for 5 grams of tested treated fiber for each of the four samples tested as described above:

Old water cavitation system (U.S. Pat. No. 9,995,002): 2,225,000 ppm (=mg/kg)

New bore cavitation system discussed herein: 7,682,000 ppm (=mg/kg).

On the bleached and then optically whitened fibers described above, the average weight of particulates in parts per million (ppm) for 5 grams of tested treated fiber was:

Old water cavitation system (U.S. Pat. No. 9,995,002): 1550 ppm (=mg/kg)

New bore cavitation system (described herein): 5200 ppm (=mg/kg).

From the results it can be concluded that a significantly larger amount of copper oxide entered the fibers with the system described herein using copper oxide in a paste compared to the copper oxide that entered the fibers using the old water-slurry system.

Example 5: Virucidal Screening Test on Articles

Textile swatches were prepared using fibers prepared according to Example 3. Swatch 1: Knitted sleeve, composed of 30 singles, using CottonX fiber (prepared according to example 3) 50%, cotton 50%. Swatch 2: 6 g gram per square meter (GSM) needle punch, non-woven material, comprising 30% CottonX fiber.

The following test conditions were used. Contact time of 5 minutes, organic load of 5% FBS in the inoculum. Testing was performed at room temperature.

The following reagents and equipment were used. Host cell growth medium: minimum essential medium (MEM) with 10% fetal bovine serum (FBS), 1×P/S. Dilution medium: MEM with 5% FBS. Neutralizer medium: MEM supplemented with 5% FBS. Recovery host cell: MRC-5 ATCC CCL-171. Host cell incubation: 37±1° C., 5% $CO_2$, 95% relative humidity. Virus: Human Corona Virus 229E, ATCC VR-740.

Circular swatches (2 square centimeters) of each fabric material were analyze for absorbency. 100 microliters (μl) of plain medium was added on the center of swatches to observe if inoculum was completely absorbed on fabric and held. in case of swatches that failed to hold the required amount of inoculum, more than one swatch was used. Swatch 1 had poor absorbency, so the medium was vortexed with the swatch. Swatch 2 was determined to have good absorbency.

For testing, fresh circular swatches were placed in sterile petri dishes. Virus, or plain media, in an amount of 100 μl was inoculated on the center of swatches for required contact time of 5 minutes, before proceeding to the neutralization step.

Neutralization involved adding 1 ml of medium with 5% FBS (neutralizer) mixed by pipetting and transferred to a sterile tube. Serial 10-fold dilutions with the dilution medium were prepared.

Infectivity assay of recovered virus was performed as follows: Host cells were plated in 96 well plates at suitable density 1 day prior to the test. Host cells were inoculated with an appropriate volume of test and controls in quadruplicate.

Incubated plates were maintained at 35±1° C., 5% $CO_2$, 90% relative humidity and monitored for CPE for 2-7 days. Cells were seeded at $2\times10^5$ cells per ml, and medium volume was 100 μl per well. Presence or absence of viral infection was monitored and recorded based on the viral cytopathic effect (CPE) on the host cells, which was distinguishable from the cytotoxic effect induced by the test article. For controls, four wells received culture media only, as cell viability control. For virus control, the positive control virus titer recovered from a plate at the same time of the test sample was determined. Recovered virus titer was at least four logs. The extent of cytotoxicity, if any, was determined for a range of 10-fold serial dilutions of the test material. The test procedure was performed to determine cytotoxicity with the exception that no virus is inoculated, substituting virus with cell culture media. Four wells per dilution were prepared and incubated under the same conditions as the test sample. For neutralization control, the process was followed as in the test procedure, substituting virus with cell culture media. Serial 10-fold dilutions were prepared, and diluted samples were mixed with approximately 100 $TCID_{50}$ of test virus, and four wells were inoculated per dilution.

The results were as follows: Virus control met the requirements with a minimum of $10^4$ $TCID_{50}$ recovered. Cell viability control met the requirements and no contamination occurred. Neutralization control demonstrated that there was no carry over virucide in the dilutions relied upon to assess whether or not the virus survived treatment.

Results for Swatches 1 and 2 are shown below in Tables 1C and 1D respectively, showing two replications for each swatch with virus. A + sign indicates presence of virus. A 0 indicates unaltered morphology, N/A indicates not applicable, and T indicates cytotoxicity.

TABLE 1C

| Dilution | Swatch 1 Replication 1 | | | | Swatch 1 Replication 2 | | | | Cytotoxicity Control | | | | Neutralization Control | | | |
|---|---|---|---|---|---|---|---|---|---|---|---|---|---|---|---|---|
| $10^{-2}$ | 0 | 0 | 0 | 0 | 0 | 0 | 0 | 0 | T | T | T | T | + | + | + | + |
| $10^{-3}$ | 0 | 0 | 0 | 0 | 0 | 0 | 0 | 0 | 0 | 0 | 0 | 0 | + | + | + | + |
| $10^{-4}$ | 0 | 0 | 0 | 0 | 0 | 0 | 0 | 0 | 0 | 0 | 0 | 0 | + | + | + | + |
| $Log_{10}$ $TCID_{50}$ | ≤1.5 | | | | ≤1.5 | | | | N/A | | | | N/A | | | |
| Average $Log_{10}$ $TCID_{50}$ | ≤1.5 | | | | | | | | | | | | | | | |
| $Log_{10}$ $TCLD_{50}$ | N/A | | | | | | | | ≤2.5 | | | | N/A | | | |
| Log Reduction | ≥3 | | | | ≥3 | | | | N/A | | | | | | | |
| Log Reduction (Average) | ≥3 | | | | | | | | | | | | | | | |

TABLE 1D

| Dilution | Swatch 2 Replication 1 | | | | Swatch 2 Replication 2 | | | | Cytotoxicity Control | | | |
|---|---|---|---|---|---|---|---|---|---|---|---|---|
| $10^{-2}$ | + | + | + | + | + | + | + | + | 0 | 0 | 0 | 0 |
| $10^{-3}$ | 0 | + | 0 | 0 | + | + | 0 | 0 | 0 | 0 | 0 | 0 |
| $10^{-4}$ | 0 | 0 | 0 | 0 | 0 | 0 | 0 | 0 | 0 | 0 | 0 | 0 |
| $Log_{10}$ $TCID_{50}$ | 2.7 | | | | 3.0 | | | | N/A | | | |
| Average $Log_{10}$ $TCID_{50}$ | 2.85 | | | | | | | | | | | |
| $Log_{10}$ $TCLD_{50}$ | N/A | | | | | | | | 0 | | | |
| Log Reduction | 1.8 | | | | 1.5 | | | | N/A | | | |
| Log Reduction (Average) | 1.65 | | | | | | | | | | | |

In only 5 minutes of exposure, each textile swatch, whether made of woven or non-woven fabric, was capable of above log 1.5 reduction of virus, and even up to log 3 reduction of human corona virus.

B. Method for Treating Sliver Fibers

The method of the present invention for surface treatment of sliver fibers with at least one insoluble particulate material comprises the following steps:

1. Preparing a paste of at least one predetermined partially insoluble particulate material, and a thickening agent in water. The amount of water should be sufficient to obtain a predetermined desired viscosity for the paste.

2. Preparing a sliver fiber ribbon or plurality of sliver fiber ribbons parallel to one another while placing them all between two webs of a moving double web conveyor system. The webs hold the sliver ribbon(s) in place. If the sliver ribbon(s) are constrained by another method or apparatus the use of a double web would not be necessary. Another type of conveyor could be used.

3. Preparing a wetting bath solution using 0.5 to 3% DH300/water solution, described above. Most typically 3% DH 300/water solution is used, however this is not intended to limit the invention when more dilute deaerating agent/water solutions are used.

4. Running the at least one sliver fiber ribbon being held in place by the double web through the wetting bath long enough to allow the sliver ribbons to wet. This typically, but without intending to limit the invention, is around 1 second.

5. After the sliver fibers are wet, passing the sliver through two rubber squeeze rollers and squeezing with a pressure of about 1-2 bars, thereby removing most of the water picked up in the wetting bath containing the deaerating solution.

6. Providing the paste to a double roller chemical dispensing system that dispenses the paste agents on both sides of the at least one sliver fiber ribbon.

7. Removing the double web. The squeezed at least one sliver fiber ribbon is then allowed to run on a hard surface. The at least one sliver fiber ribbon is pulled in the direction of a set of squeeze rollers on the downstream side of a bore sonotrode.

8. Squeezing the paste coated sliver through another set of squeeze rollers which are soft and not made of a hard rubber. These rollers are meant to push the agents of the paste into and between the individual fibers of the ribbon. Excess paste is pushed out of the sliver fiber ribbon.

9. Optionally, passing the sliver ribbons through a constraining or folding device where they are constrained or folded.

10. Pulling the ribbons so as to enter a bore of a sonotrode for exposure of the ribbons to ultrasonic sound waves while in the bore.

11. After the sliver exits the sonotrode, optionally separating and releasing the sliver ribbons on the downstream side of the sonotrode. This step is optional as the constrained sliver ribbons can often release themselves if not constrained.

12. Bringing the sliver ribbons to a conveyor, which carries the now cavitated sliver fibers to a cleaning station where they are either sprayed or bathed or both in water and soap to remove any remaining thickening agent and loose particulates.

13. Drying the fibers.

14. Placing the dry fibers in containers for storage or transport.

If bleaching and/or whitening is desired or required, then it is generally carried out after step 13 using the procedures and techniques described herein above.

After drying and packing, the sliver fiber ribbon proceeds directly to yarn production with no changes, adjustments or additions necessary to any of the subsequent conventional yarn forming processes and machines.

It should be evident that the above discussed method provides a solution to the following problems:

Since sonication is not carried out in a liquid bath, sliver fiber dispersal and disordering is less than when a liquid bath is used.

Since the sliver fibers are coated with a relatively thick paste, sliver fiber dispersal and disordering is further limited.

Because the sliver ribbon is optionally constrained, fiber dispersal and disordering that can result in a liquid or while cavitated is further reduced.

Since a paste is used to coat the sliver, a larger amount of particulates can be embedded in the sliver fibers than when a particulate-water slurry is used. The particulates in a water slurry used previously can be considered to be more dilute than when a paste is used. As a result, the concentration of particles introduced into the fibers via the paste is greater and the activity of the processed fibers is extended. For example, the yarn and fabric made from the treated fibers have been found to survive 100 home washings or 50 industrial washings.

Because the sliver ribbon passes through a bore in the bore sonotrode, the fibers are closer to the energy source than in other more conventional sonotrode configurations. In the latter, the waves travel longer distances through a condensed phase (liquid) leading to greater energy loss than in the present invention. Additionally, a shorter exposure time to the ultrasonic waves in the cavitation process will be achieved, again reducing energy used. When energy usage and losses are lower, the efficiency of the embedding process is enhanced. As a result, more particles can be embedded and particles can even be attached to the lumen of the fiber.

Because the sliver fibers are only minimally dispersed or otherwise disordered during the treatment process described herein above, there is no need for passing the fibers again through a second carding process to reorient them. This results in less damage to the sliver fibers and a reduction in the amount and cost of sliver used.

Since particulates can be impregnated in the lumen of a fiber, use of bleaching and optical whitening of the fibers can be used without diminution of efficacy of the particulates.

In view of the above, sliver fibers, particularly, but not necessarily limited to, cellulose fibers, have become tractable substrates for surface treatment using the new method and system discussed herein. Treatment no longer needs to be effected solely at the yarn or fabric stage of processing.

C. Treated Fibers

The present application teaches fiber impregnation with insoluble particulates that impart at least one preselected desired property to the fibers. Impregnated fibers, particularly cellulose fibers, must retain the at least one preselected property imparted to the fibers for a long period of time. Specifically, one of the goals of the present method and system is to provide fibers that retain the one or more imparted properties after 100 home washings or 50 industrial washings.

An additional problem that needs to be overcome is to ensure that the strength of the fiber, that is its tensile strength, is retained after treatment and subsequent washings. Generally, tensile strength decreases when fibers undergo treatment of any kind. Even the relatively innocuous treatment of washing a fiber, yarn, or textile results in a decrease in fiber tensile strength.

The paste-treated fibers described herein contain more than 3 times the amount of particulates embedded (or otherwise attached) than observed in previous water-treated fibers. (See Example 4 of Section A above). This is a result of: 1 the use of a bore sonotrode where the distance from the fibers to the sonotrode is much reduced compared to the flat (square or rectangular) plate and semi-circular sonotrodes used previously. Therefore, more of the energy of the sonotrode is available for embedding more particulates, deeper within the fiber. The fibers pass through the at least one bore of the sonotrode and not under or around a flat plate (square or rectangular) or semi-circular sonotrode. The latter fiber paths result in more attenuated, less energetic ultrasonic waves impinging on the fibers; and 2. the abandonment of a particulate-water slurry in favor of a damp paste containing particulates. The paste is dispensed directly on top and bottom of a sliver fiber ribbon. Without being bound by theory it is believed that the paste's dampness provides sufficient liquid for carrying the ultrasonic waves away from the sonotrode to the fibers and for embedding the insoluble particulates in the fibers. A paste containing the particulates to be embedded and a thickening agent in a small amount of water results in a damp, but not wet, paste. The moist (damp) media is surprisingly efficient in conveying ultrasonic waves so that the particulates in the paste can be embedded in the fibers.

It was also found that when the sliver fibers were cavitated/sonicated with a bore sonotrode and when the fibers had been previously or simultaneously been exposed to a 3% DH300 deaerating agent/water solution, the yarns made from such fibers exhibit increased tensile strength when compared to fibers and yarns not subjected to a deaerating solution. Articles and yarns made from such increased strength fibers also exhibit increased strength. This increase in strength of the treated fiber is a result contrary to what would be expected.

It should be understood that since no liquid bath is used to cavitate the fibers in the present invention, the treated sliver fibers do not disperse and do not lose their original parallel orientation, even in the presence of energetic ultrasonic waves.

A further surprising effect was observed in the sliver cotton fibers when only a deaerating agent/water solution, here DH300, was used. It was found that when a small amount, as little as 0.5% w/w to water, of the deaerating solution was added to the wetting bath of the fibers, the deaerating solution during cavitation caused the formation of small holes, also at times herein denoted as "pores". See FIGS. 6 and 7 and 8 discussed herein. This was not the case when fibers were passed through a deaerating solution bath comprised of 1.5% DH300/water solution and just soaked without being cavitated. Hence, cavitation of the fibers in a bath comprising only a deaerating solution changed the structure of the fibers introducing holes.

Without restricting ourselves to theory, it is believed that these pores soften the cellulose. This provides for a more efficient use of the energy provided by a sonotrode which drives the particulates into, or through, the cuticle of the fiber toward, and into, its lumen. This effect is observed in FIGS. 7 and 8 discussed below. Because the treatment of cavitation takes place at the fiber level, any use of treated staple cotton fibers can be converted into yarns and then into knit, woven or non-woven products, all possessing the desired preselected properties of the treated fibers.

Examples of articles which can be made from yarns incorporating fibers into which copper oxide or other insoluble particulates have been embedded include: apparel for wear whether woven or knit that uses impregnated fibers or a blend of fibers one of which has been impregnated; products made from non-woven materials made from impregnated staple fibers; medical products that use staple cotton or paper; consumer home textiles such as towels and sheets; and textiles used in cooking, kitchens, or food related industries. There would also be application of these fibers/yarns in liquid filters, masks, non-woven disposable garments, and cosmetic cleaning pads. It should be understood that the above examples of articles that can be made from fibers treated as discussed above are not to be deemed exhaustive, limiting the invention.

Much useful information related to the discussion above can be extrapolated from the SEM photographs of treated fibers discussed below. One of the most important features of the treated fibers is the presence of particulates in the fiber's lumen.

Figure 3:
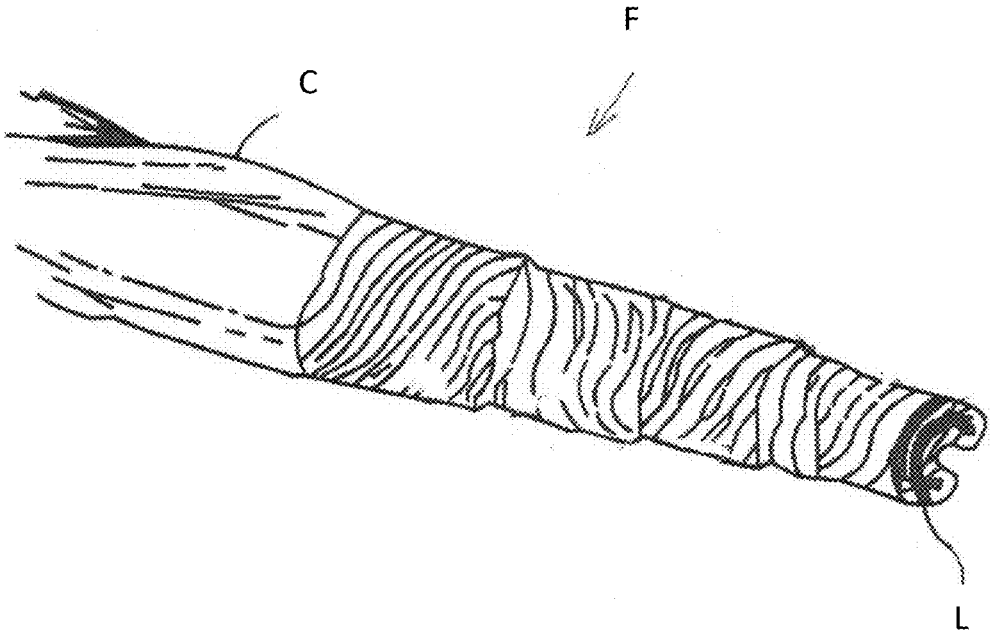
FIG. 3 is a schematic presentation of the structure of a single cotton fiber.

FIG. 3 is shown as general information. FIG. 3 is a schematic drawing of the structure of a single cotton fiber (F). In the drawing, the cuticle (C) and internal lumen (L) are clearly shown.

Figure 4:
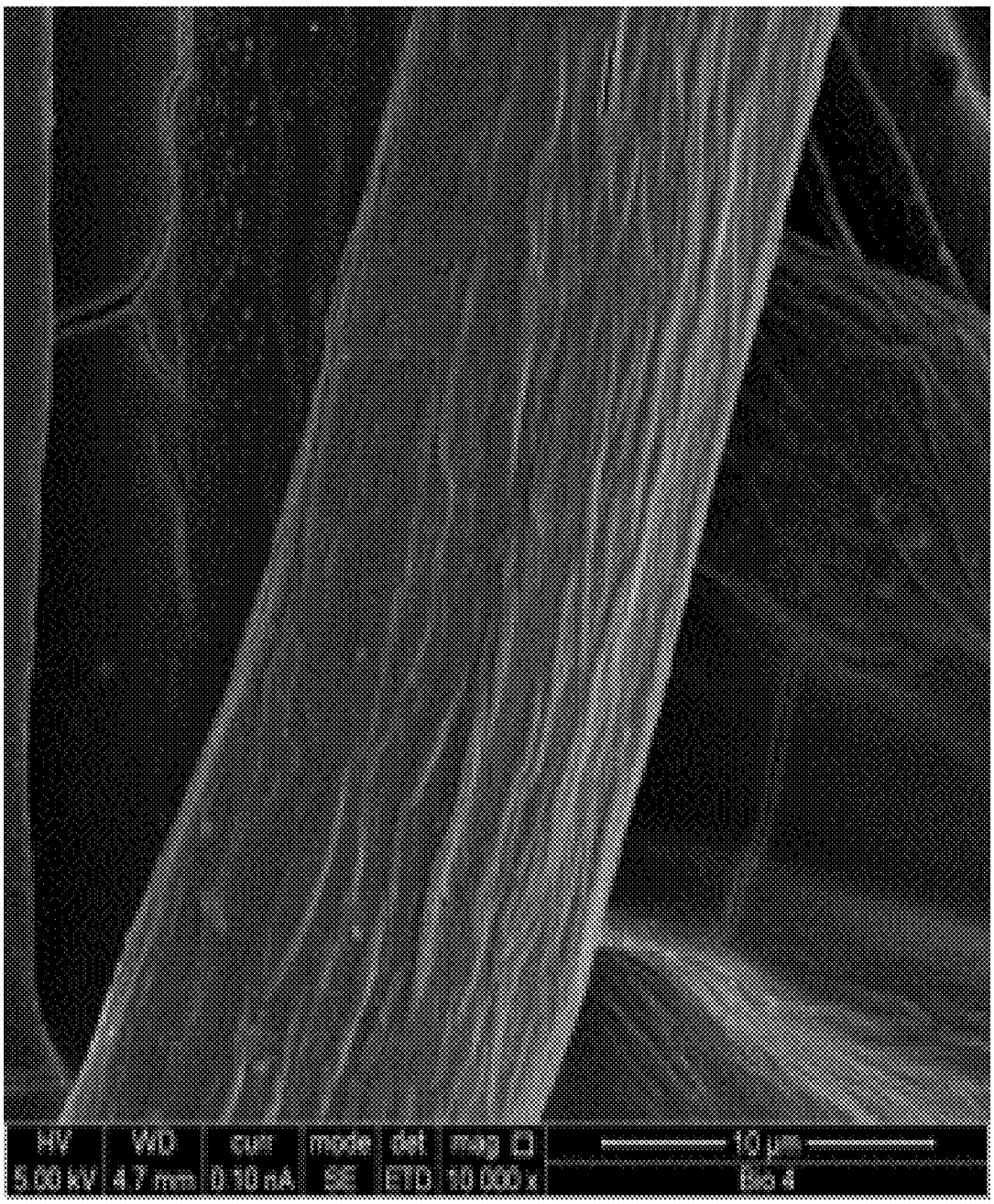
FIG. 4 is a scanning electron microscope (SEM) photograph of cotton fibers without treatment with a deaerating agent/water solution and without cavitation.

FIG. 4 is a SEM photograph of cotton fibers without the application of a deaerating agent, such as DH 300. DH 300 is comprised of a combination of ethylene oxide adducts with defoaming components, such as polysiloxane. Typically, the DH300 is applied as a 3% water solution, but in some cases as little as 0.5% DH300 may be used. Additionally, the fiber shown has not been treated with the particulates discussed herein and has not been exposed to ultrasonic waves generated by a sonotrode used in cavitation.

Figure 5:
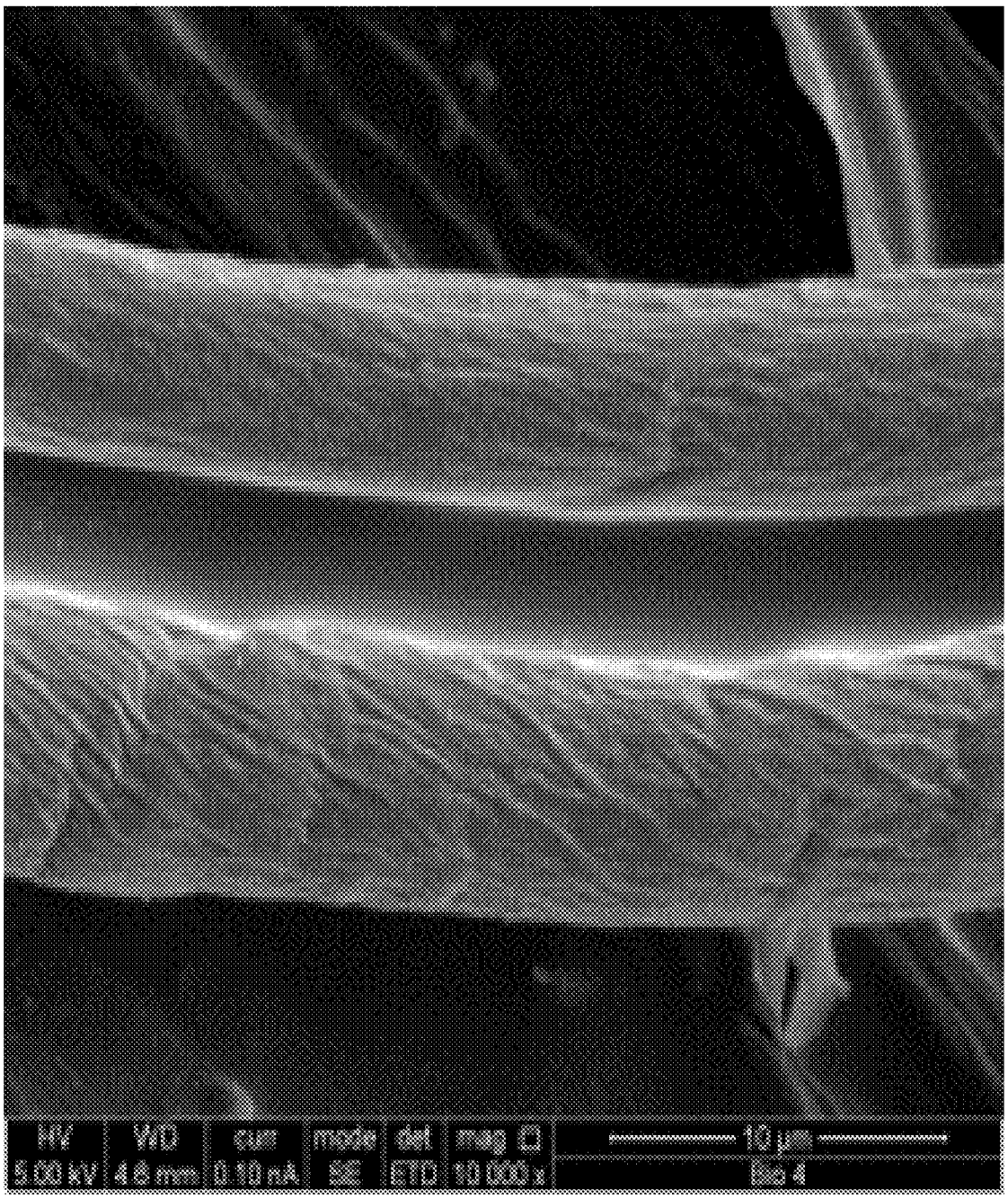
FIG. 5 is a SEM photograph of cotton fibers which have been cavitated and not treated with a deaerating agent/water solution DH 300.

FIG. 5 is a SEM photograph of a cotton fiber which has been cavitated but without the use of a deaerating agent DH 300/water solution on the fiber. The fiber was exposed to ultrasonic waves from a bore sonotrode for 1-2 seconds. It can be observed that that there is no difference between FIGS. 4 and 5.

Figure 6:
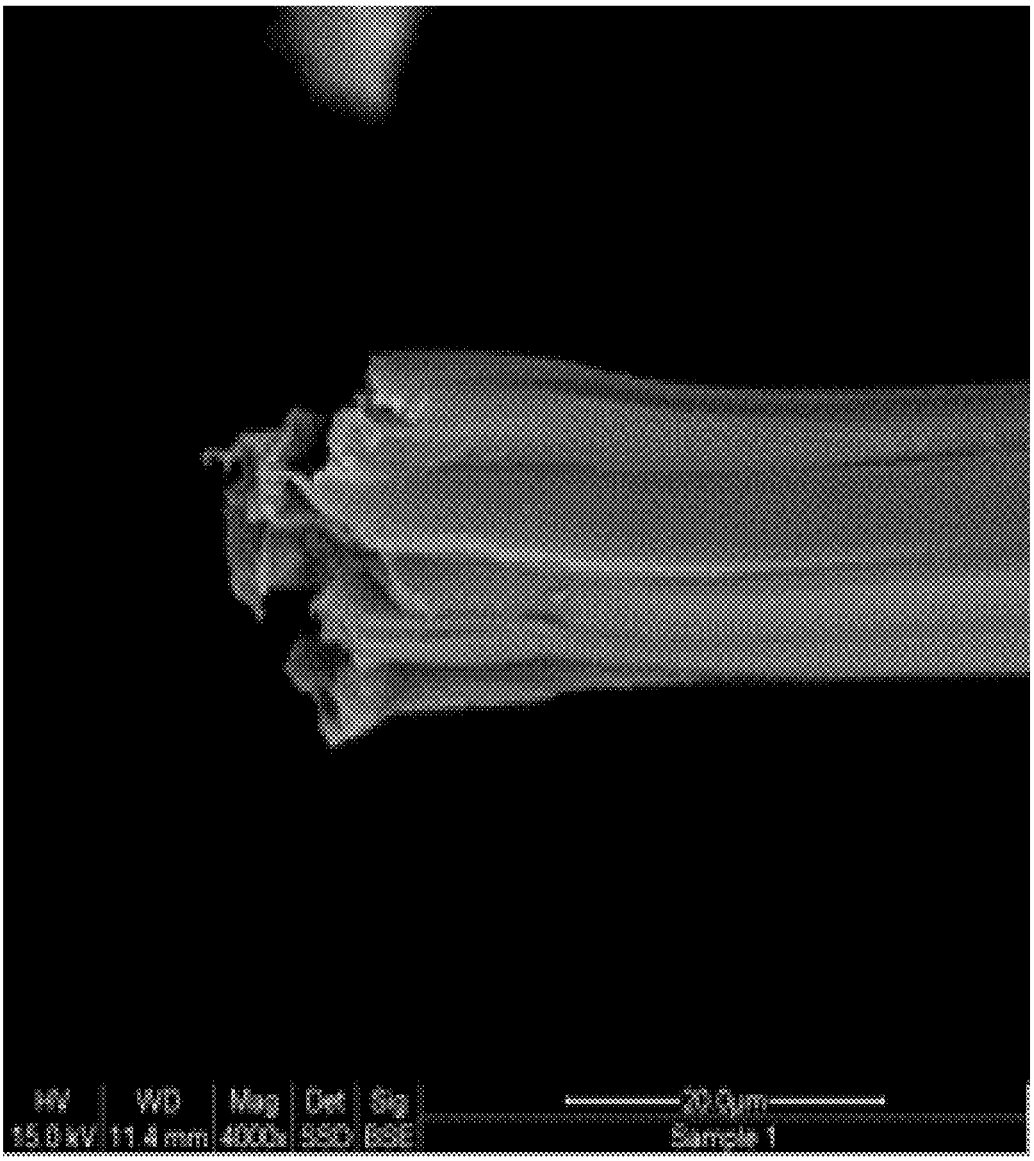
FIG. 6 is a SEM photograph of cotton fibers which have been treated only with DH300, a deaerating agent/water solution, and not cavitated.

FIG. 6 is a SEM photograph of a cotton fiber which has been treated with a 1.5% water solution of DH300 deaerating agent for 10 minutes but is not cavitated.

Figure 7:
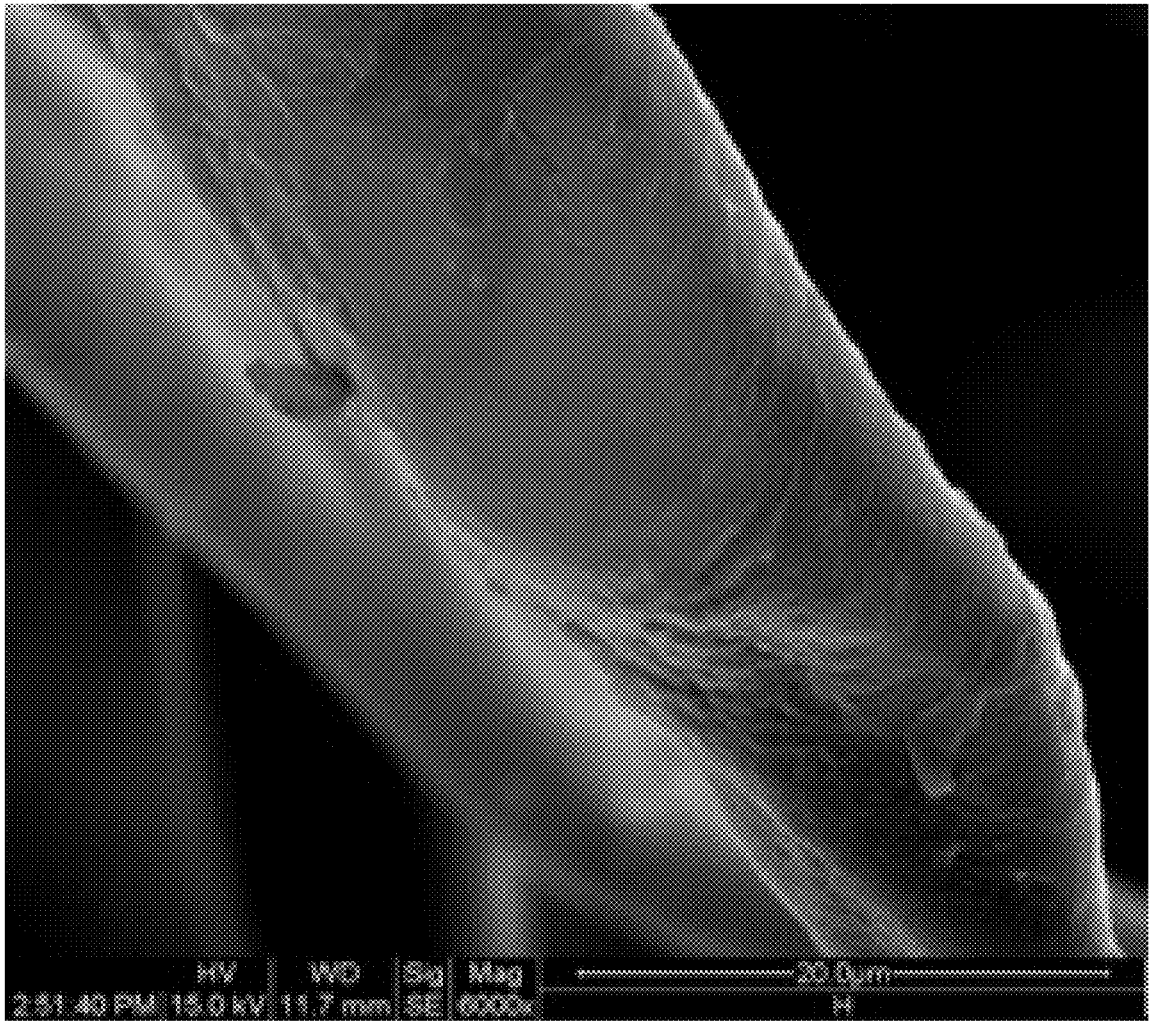
FIG. 7 and FIG. 8 are SEM photographs of fibers of cotton which have been cavitated with copper oxide particulates in a 1.5% DH300 deaerating agent/water solution.
Figure 8:
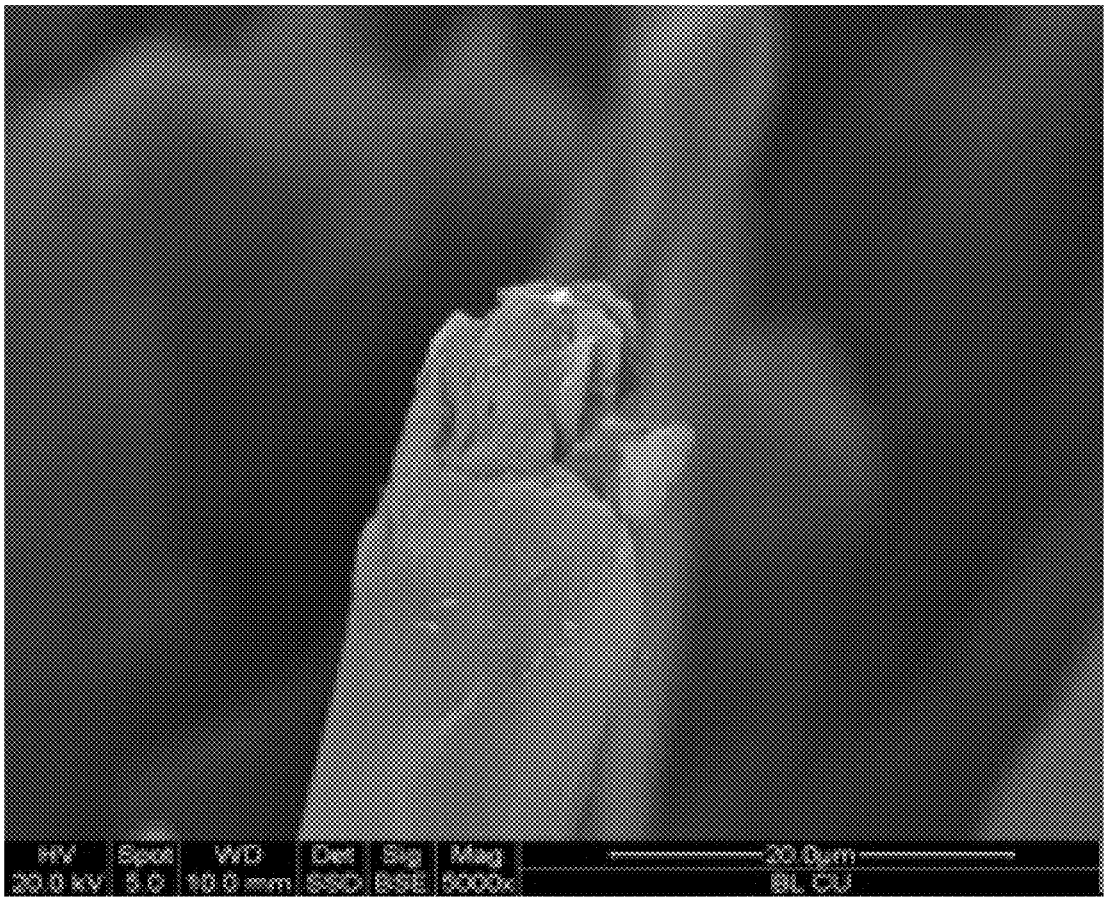

FIG. 7 and FIG. 8 are SEM photographs of cotton fibers which have been cavitated in a 1.5% aqueous solution of DH 300 deaerating agent with copper oxide particulates for less than 1 second, Note the large hole in the fiber in FIG. 7 and the small holes in FIG. 8. FIG. 7 shows a view along the length of the cotton fiber while FIG. 8 shows a treated cotton fiber cut in a direction essentially transverse to the long axis of the fiber. The size of the "pores" are believed to be dependent on the weakness of the cuticle at the spot of the resultant pore.

Figure 9:
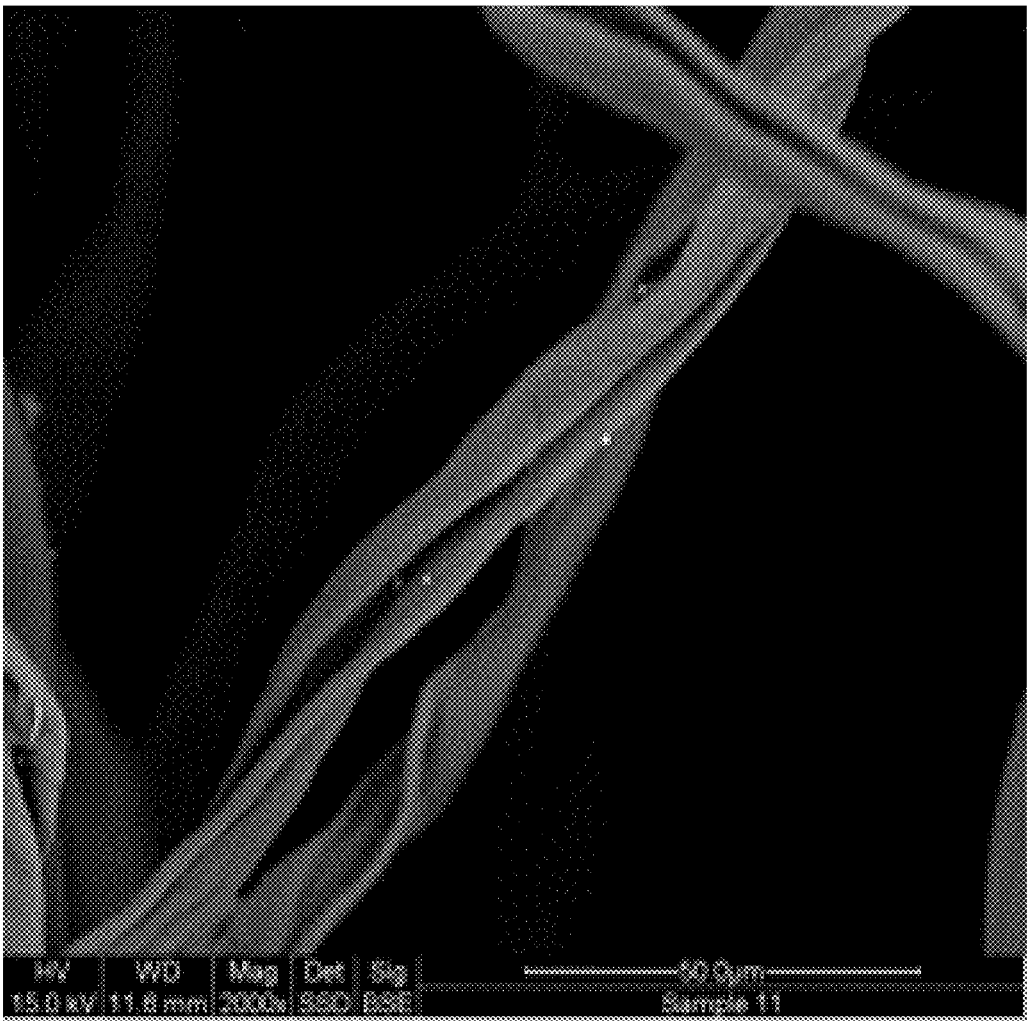
FIG. 9 is a SEM photograph of cotton fibers that have been treated with a surfactant and cavitated with copper oxide.

FIG. 9 is a SEM photograph of a fiber that was cavitated with copper oxide particulates after being treated with a surfactant. Note the amount of copper on the surface of the fibers which appear as white dots on the fiber. There are copper oxide particles in the exterior folds of the cotton but not in the lumen of the cotton.

FIG. 10 is a SEM photograph of a fiber that was treated with defoamer DH300 and then cavitated with copper oxide. Note the vastly increased amount of copper particles on the outside surface of the fiber over FIG. 9 with some even positioned in the lumen.

FIG. 11 is a SEM photograph of a fiber that was treated with DH300/water solution and then cavitated with copper oxide. The treated fiber was then bleached and then optically whitened as discussed herein above. The fiber was then burned open by the probe of the SEM. Note that a very large amount of copper oxide is still within the fiber even after the bleaching and optical whitening processes. Note also that since the fibers were bleached and then optically whitened their appearance to the naked eye, which is different than when viewing a fiber under the lens of an SEM, is snow white. See also the XRF results in Example 4 discussed above in Section A with regard to the sample in this photograph. As can be seen, the copper oxide particulates, which appear white in the photograph, not only pierce the cuticle but can be observed deep in the fibers near or within the lumen.

Tables 2A, 2B and 2C which follows show the basic physical properties of cotton fibers which were cavitated using the system and method described herein and compared with cotton fibers which were not cavitated. It provides a complete picture of the quality of the fibers examined. The tests in Tables 2A, 2B and 2C were performed by the Israel Cotton Growers Association, Herzliya, Israel. The Cu concentration is estimated and expressed in ppm.

TABLE 2A

| Batch | Cu concentration | Moisture content (%) | Micronaire | Maturity Index |
|---|---|---|---|---|
| 1 | 1236 | 5.8 | 5.24 | 0.89 |
| 2 | 1308 | 5.7 | 5.14 | 0.89 |
| 3 | 1610 | 5.7 | 5.04 | 0.89 |
| 4 | 3049 | 5.6 | 5.24 | 0.89 |
| 5 | 353 | 5.7 | 5.42 | 0.90 |
| 6 | 2052 | 5.7 | 5.30 | 0.89 |
| 7 | 2600 | 6.1 | 5.34 | 0.89 |
| 8 | 2408 | 6.0 | 5.21 | 0.89 |
| 9 | 2693 | 5.8 | 5.28 | 0.89 |
| 10 | 3411 | 6.0 | 5.33 | 0.89 |
| 11 | 1736 | 6.2 | 5.19 | 0.89 |
| 12 | 3246 | 6.1 | 5.19 | 0.89 |
| 13 | 3291 | 6.4 | 5.44 | 0.89 |
| 14 | 2918 | 6.6 | 5.23 | 0.89 |
| 15 | 1894 | 6.4 | 5.30 | 0.89 |
| 16 | 1502 | 6.7 | 5.28 | 0.89 |
| 17 | 1928 | 6.3 | 5.18 | 0.89 |
| 18 | 3018 | 6.4 | 5.15 | 0.89 |
| 19 | 1134 | 6.5 | 5.11 | 0.89 |
| Average | 2398 | 6.1 | 5.2 | 0.9 |
| Standard Deviation | 806.0 | 0.33 | 0.1 | 0.0 |
| RSD % | 33.6 | 5.7 | 1.9 | 0.3 |
| Lower limit | 1134.0 | 5.6 | 5.10 | 0.89 |
| Upper limit | 3535.0 | 6.7 | 5.44 | — |

TABLE 2B

| Batch | Upper half mean length (mm) | Short Fiber Index (%) | Spinning Consistency Index | Strength (g/tex) | Elongation (%) | Amount (mg) |
|---|---|---|---|---|---|---|
| 1 | 29.03 | 6.0 | 156 | 38.3 | 5.8 | 451 |
| 2 | 29.24 | 5.8 | 153 | 36.8 | 6.0 | 499 |
| 3 | 28.22 | 6.1 | 154 | 38.2 | 5.9 | 376 |
| 4 | 28.19 | 5.85 | 146 | 36.6 | 5.6 | 383 |
| 5 | 28.93 | 6.3 | 139 | 34.1 | 5.4 | 479 |

TABLE 2B-continued

| Batch | Upper half mean length (mm) | Short Fiber Index (%) | Spinning Consistency Index | Strength (g/tex) | Elongation (%) | Amount (mg) |
|---|---|---|---|---|---|---|
| 6 | 27.91 | 6.3 | 130 | 32.9 | 5.5 | 542 |
| 7 | 29.87 | 5.3 | 152 | 38.5 | 6.0 | 435 |
| 8 | 28.60 | 6.1 | 154 | 38.0 | 5.6 | 418 |
| 9 | 28.30 | 6.1 | 134 | 35.3 | 5.4 | 492 |
| 10 | 30.38 | 5.2 | 162 | 39.3 | 5.8 | 448 |
| 11 | 29.08 | 5.8 | 160 | 39.0 | 6.2 | 525 |
| 12 | 28.98 | 5.6 | 148 | 36.5 | 5.7 | 569 |
| 13 | 29.39 | 5.9 | 143 | 34.5 | 5.8 | 600 |
| 14 | 28.65 | 5.4 | 150 | 37.2 | 6.0 | 456 |
| 15 | 28.17 | 6.2 | 149 | 37.2 | 6.4 | 495 |
| 16 | 29.11 | 5.9 | 165 | 41.4 | 6.1 | 571 |
| 17 | 29.51 | 5.2 | 159 | 38.6 | 5.6 | 409 |
| 18 | 28.14 | 5.7 | 143 | 38.7 | 6.0 | 475 |
| 19 | 29.03 | 5.7 | 161 | 40.1 | 6.3 | 415 |
| Average | 28.88 | 5.8 | 150.4 | 37.4 | 5.8 | 475.7 |
| Standard Deviation | 0.6 | 0.3 | 9.6 | 2.1 | 0.3 | 64.4 |
| RSD % | 2.2 | 6.0 | 6.4 | 5.7 | 5.0 | 13.5 |
| Lower limit | 27.9 | 5.2 | 130.0 | 32.9 | 5.4 | 376 |
| Upper limit | 30.4 | 6.3 | 165.0 | 41.4 | 6.4 | 600 |

TABLE 2C

| Batch | Reflectance Rd | Yellowness + b | Color Grade (Upland) | Trash Count |
|---|---|---|---|---|
| 1 | 61.8 | 11.2 | 53-3 | 0 |
| 2 | 66.2 | 9.7 | 53-1 | 0 |
| 3 | 59.7 | 12.2 | 54-1 | 1 |
| 4 | 60.5 | 11.9 | 54-1 | 1 |
| 5 | 58.6 | 11.1 | 53-4 | 1 |
| 6 | 60.3 | 12.7 | 44-2 | 1 |
| 7 | 59.8 | 12.3 | 54-1 | 2 |
| 8 | 62.1 | 12.0 | 44-2 | 2 |
| 9 | 57.9 | 12.7 | 54-1 | 4 |
| 10 | 57.6 | 12.6 | 54-1 | 3 |
| 11 | 60.0 | 13.0 | 44-4 | 1 |
| 12 | 58.3 | 13.3 | 54-3 | 1 |
| 13 | 58.3 | 12.7 | 54-1 | 0 |
| 14 | 60.5 | 12.8 | 44-2 | 1 |
| 15 | 62.9 | 12.8 | 44-1 | 3 |
| 16 | 62.3 | 11.3 | 53-3 | 0 |
| 17 | 57.8 | 13.6 | 44-4 | 0 |
| 18 | 58.6 | 13.0 | 54-3 | 1 |
| 19 | 67.7 | 11.1 | 43-1 | 4 |
| Average | 60.6 | 12.2 | — | — |
| Standard Deviation | 2.8 | 1.0 | — | — |

TABLE 2C-continued

| Batch | Reflectance Rd | Yellowness + b | Color Grade (Upland) | Trash Count |
|---|---|---|---|---|
| RSD % | 4.6 | 7.9 | — | — |
| Lower limit | 57.6 | 11.2 | 44-1 | — |
| Upper limit | 67.7 | 13.6 | 53-4 | — |

The tests performed in the chart in Table 2 above are all automated standard tests performed on all bales of cotton grown in the world that are sold for the purposes of making yarns or being used as cotton in medical and cosmetic end uses. The tests are all conducted using a single fiber quality reader.

The fibers in the chart were prepared using the 1.5% DH300 deaerating agent/water solution and copper oxide particulates and then cavitated. Tables 2A, 2B and 2C show the test results of fibers which have been impregnated with copper oxide using the system and method described herein above in Sections A and B. The test provides an average value of 19 different samples and compares one or more samples of treated cotton to the same cotton when untreated. The fiber used for both the treated and untreated samples in these tests was Upland Greek cotton fibers. Table 2D shows values relating to three samples of untreated fibers from the same starting material as was treated.

TABLE 2D

| Sample | Micronaire | Upper Half Mean Length (mm) | Strength (g/tex) | Reflectance Rd | Yellowness | Color Grade |
|---|---|---|---|---|---|---|
| Untreated 1 | 4.6 | 29.8 | 29.3 | 71.7 | 8.4 | 41-2 |
| Untreated 2 | 4.8 | 29.5 | 31.4 | 72.3 | 9.1 | 41-3 |
| Untreated 3 | 3.9 | 29.1 | 31.4 | 70.4 | 8.9 | 41-4 |
| Average | 4.4 | 29.5 | 30.70 | 71 | 8.8 | — |

The two parameters that are of greatest interest to someone familiar with the art are the micronaire test results and the strength (g/tex) test data. These two tests inform the user as to how dense the fibers are and how strong they are, respectively. These quality and strength test results are also reflected in yarns made from the tested fibers and articles made from the yarns.

Micronaire is an indicator of air permeability. It is regarded as an indicator of both fiber fineness (linear mass density) and maturity which is determined by the degree of cell-wall development. The latter characteristic is a function of fiber maturity.

Looking at Tables 2A, 2B and 2C, there is a comparison of the various tests performed on the cavitated fibers compared to normal uncavitated natural cotton fibers, in Table 2D. In the comparison, both the source and quantity of the cotton fibers tested are the same. The results of the comparative tests show that a fibre cavitated with copper oxide, water and DH300 demonstrates a surprising increase in micronaire results and tensile strength which is not the case when cavitation takes place without the DH300.

The copper oxide treated cotton using the system and method for fiber treatment discussed hereinabove provides an average micronaire reading of 5.2 compared to untreated cotton where a value of 4.35 was obtained. Thus, the density has increased with treatment. This increase in density of the treated cotton fibers would normally be reflected in added resistance to abrasion and toleration of more washings.

The treated fibers using the process and method discussed herein above showed an average tensile strength value of 38.7 grams/tex. The same cotton fibers when untreated showed a value of 30.7 grams/tex. Generally, a value above 31 is very strong. The strength test showed that the applicant's copper oxide treated cotton had a value significantly above values deemed to be strong 29-30 or very strong 31 or above. This increase in tensile strength is unexpected as treating fibers generally is expected to weaken them. This is readily observable when washing fabrics. The more times a textile is washed, the weaker its fibers become.

A wash test of fabric made from fibers described above was carried out. The fabric was bleached, dyed and washed for 100 home washings or 50 industrial washings. After washing, its bactericidal efficacy was tested and found not to have deteriorated. The tests were done by an independent testing lab Manufacturing Solutions Centre of Conover, N.C., USA using 2003 AATCC Standard of Reference Liquid Detergent WOB. The bactericidal efficacy test used was AATCC-Test 100-2012—Assessment of Antibacterial Finishes on Textile Materials.

The treated fibers have the following features:

Greater amounts of embedded preselected particulates than when prepared by prior art systems and methods. See comparative XRF data in Example 4 of Section A.

Particles and materials are embedded within the interior of the fiber, even reaching the fiber's lumen, and not just remaining near or on the exterior of the fiber's cuticle.

Micronaire value is increased.

Tensile strength is increased to at least 36 g/tex.

Visually the treated fibers do not appear to be seen to be different from untreated fibers.

Treated fibers cannot be felt to be different from untreated fibers.

Without intending to limit the invention, the method and system of the present invention may be used to impart the following features to sliver fibers, particularly cellulose sliver fibers, when appropriate particulates are embedded or otherwise attached to the fibers:

To impart non-ignition or retarded ignition properties to sliver fibers, wherein at least one preselected compound or composition is a water-insoluble particulate compounds and compositions which may contain waters of hydration or oxygen scavengers or intumescent compounds. These compounds or compositions include, but are not limited to, at least one compound or composition selected from the group consisting of: Huntite ($Mg3Ca(CO3)4$), magnesium hydroxide, alumina trihydrate, and combinations thereof.

To impart antimicrobial properties, including antibacterial, antifungal, and/or antiviral properties, to sliver fibers, wherein the at least one preselected compound or composition is a water insoluble antimicrobial compound or composition containing metals and/or oxides thereof. The metal oxides thereof may be selected from the group consisting of silver oxides, copper oxides, magnesium oxide, zinc oxide, various zeolites or ceramic compounds, and combinations thereof;

To impart pesticidal, acaricidal, and anti-bedbug properties to sliver fibers, wherein the at least one preselected compound or composition is selected from the group consisting of diatomaceous earth, copper oxides, silver oxides, zinc oxide, and combinations thereof;

To impart waterproofing properties to sliver fibers, wherein the at least one preselected compound is selected from the group consisting of a hydrophobic material such as ground silica, nano-silica in a water suspension, polysiloxanes, and acrylic compounds;

E. To impart UV inhibiting properties to the sliver fibers, wherein the at least one preselected compound or composition is selected from the group consisting of zinc oxide, and titanium dioxide.

To impart medicinal properties to the sliver fibers for transdermal medicinal transport or dermal treatment, wherein the at least one preselected compound or composition is selected from the group consisting of copper oxides, silver oxides, encapsulated nano-spheres containing various pharmaceuticals and combinations thereof;

To impart cosmetic properties to the sliver fibers for dermal treatment, wherein said at least one preselected compound or composition is selected from the group consisting of copper oxides, silver oxides, benzoyl peroxide or any other pharmaceutical for treatment of acne, encapsulated organic compounds and combinations thereof.

To impart electrical conductivity to the sliver fibers, wherein said at least one preselected compound or composition is selected from the group consisting of powdered graphite, graphene powder and single walled nano-carbon tubes. These can be used to form electrically conductive yarns and fabrics which can be used in fabricating, among other articles, anodes and cathodes for batteries.

To impart increased absorption of water or a compound that has the viscosity of water into cotton fibers using nanocellulose.

The above surface treatments and the possible particulates or other materials that may be used are to be deemed exemplary only. Other surface treatments and other materials would readily come to mind to persons skilled in the art. Similarly, while cotton fibers have been described as the substrate, they are only exemplary. Other cellulose fibers as well as other natural fibers may also be treated with the system and method described herein.

The system and method of the present invention solve several problems related to surface treatment of sliver fibers. In particular, it allows for treated sliver fibers that have:

1. A greater concentration of particulates embedded/attached to the sliver fibers as compared to when no thickening agent is used. As a consequence of this, when the fibers are treated with particulates having, for example, antimicrobial properties, the fibers have enhanced efficacy, their activity is accelerated and the lifetime efficacy of the article made from the treated fibers is extended. The activity of the fibers continues with minimal deterioration after 100 home washings or 50 industrial washings.

2. Particulates impregnated in the lumen of the fibers. Inter alia, this allows for producing snow white fibers by use of bleaching and optical whitening of the fibers without diminution of efficacy.

3. A surprising increase in micronaire value of the fibers making them more resistant to abrasion.

4. A surprising increase in tensile strength, making for a stronger yarn.

In view of the above, sliver fibers, particularly, but not necessarily limited to, cellulose fibers, have become tractable substrates for surface treatment using the new method and system discussed herein. Treatment no longer needs to be effected solely at the yarn or fabric stage.

In jurisdictions allowing it, all publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The above uses of the system and method of the present invention are not intended to be an exhaustive list of uses of the system and method of the present invention. Similarly, the list of materials for each use is not intended to be exhaustive and should be considered as exemplary only.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and scope of the appended claims.

I claim:

1. An impregnated natural fiber comprising:

a cuticle and an interior lumen, the cuticle circumscribing the interior lumen; and insoluble particulates possessing a preselected property embedded in the fiber, wherein the particulates are selected from the group consisting of: huntite, magnesium hydroxide, alumina trihydrate, silver oxide, copper oxide, magnesium oxide, zinc oxide, a ceramic compound, diatomaceous earth, ground silica, nanosilica, polysiloxane, acrylic compound, titanium oxide, a nanosphere encapsulating a pharmaceutical, benzoyl peroxide, graphite, graphene, and nano-carbon tubes.

wherein, after bleaching and optical whitening of the impregnated fiber, the fiber comprises greater than 5200 mg/kg and up to 30% of said particulates relative to the impregnated fiber and said embedded particulates impart their preselected property to the fiber when embedded therein, and where the particulates are embedded on both the cuticle and within the lumen of the fiber.

2. The impregnated fiber of claim 1, wherein the impregnated fiber exhibits a tensile strength in excess of 36 g/tex.

3. The impregnated fiber of claim 1, wherein the impregnated fiber exhibits an increase in tensile strength after impregnation that is at least 15% greater than the average tensile strength of untreated fibers drawn from the same fiber source as the fiber of the impregnated fiber.

4. The impregnated fiber as in claim 1, wherein the impregnated fiber exhibits a micronaire value in excess of 4.85.

5. The impregnated fiber as in claim 1, wherein the impregnated fiber exhibits a micronaire value after impregnation at least 20% greater than the average micronaire value of untreated fibers drawn from the same fiber source as the fiber of the impregnated fiber.

6. A yarn formed from the impregnated fiber as in claim 1, wherein the yarn still exhibits the preselected property after 100 home washings or 50 industrial washings.

7. A yarn formed from the impregnated fiber as in claim 1, wherein the yarn still exhibits the preselected property after the fiber has been bleached and optically whitened.

8. A yarn formed from the impregnated fiber as in claim 1, wherein the yarn still retains particulate material in the lumens of the fiber after bleaching and optical whitening while the number of particulates from an exterior face of the cuticle of the fiber have been reduced by at least 95%.

9. The impregnated fiber as in claim 1, wherein the impregnated particulates comprise at least 0.5-20 wt. % of the impregnated fiber.

10. The impregnated fiber as in any one of claim 1, wherein the insoluble particulates are nano-sized particulates between 0.1 and 0.5 microns.

11. The impregnated fiber as in claim 1, wherein the fiber is a cellulose fiber.

12. The impregnated fiber as in claim 1 wherein the insoluble particulates are preselected to impart antimicrobial properties, including antibacterial and/or antifungal, and/or antiviral properties, to the fiber and are chosen from the group consisting of silver oxides, copper oxides, magnesium oxide, zinc oxide, zeolites, ceramic compounds and combinations thereof.

13. The impregnated fiber as in claim 12 wherein the insoluble particulates comprise copper oxides.

14. The impregnated fiber as in claim 12 wherein the fiber, upon contact with a virus, exhibits an antiviral property as compared to a comparable fiber free of said particulates.

15. The impregnated fiber as in claim 14 wherein the virus is a human corona virus.

16. Yarn spun from a plurality of impregnated fibers, according to claim 1.

17. An article comprising the impregnated fibers as in claim 1, the article selected from a group consisting of the following classes of articles: wearing apparel; medical and hospital supplies, uniforms, curtains, scrubs, sheets, pillowcases, blankets, slippers, patient gowns, towels and any textile or product made from a textile used in a healthcare environment, an elderly care facility, a public or private institution, or as a domestic product used in the home.

18. The impregnated natural fiber according to claim 1 wherein the particulate is a metal oxide.

19. The impregnated natural fiber according to claim 1 wherein the bleaching is performed at 50° C. for 10 minutes.

20. The impregnated natural fiber according to claim 1 wherein the optical whitening is performed using 1.5 g/L of sodium hyposulfite dissolved in deionized water, heated at 60° C. for 15 minutes, followed by washing with soap and water and followed by a rinse in water kept at room temperature, then drying in an oven at 100-130° C. for 5-15 minutes.

* * * * *